US010077059B2

(12) United States Patent
Moynihan

(10) Patent No.: US 10,077,059 B2
(45) Date of Patent: Sep. 18, 2018

(54) SYSTEM FOR CONTAINING DERAILMENT OF A RAILWAY VEHICLE

(71) Applicant: Patrick J Moynihan, Grapevine, TX (US)

(72) Inventor: Patrick J Moynihan, Grapevine, TX (US)

( * ) Notice: Subject to any disclaimer, the term of this patent is extended or adjusted under 35 U.S.C. 154(b) by 242 days.

(21) Appl. No.: 15/144,314

(22) Filed: May 2, 2016

(65) Prior Publication Data

US 2016/0347332 A1 Dec. 1, 2016

Related U.S. Application Data

(60) Provisional application No. 62/166,679, filed on May 26, 2015.

(51) Int. Cl.
*B61F 11/00* (2006.01)
*B61F 9/00* (2006.01)

(52) U.S. Cl.
CPC ..... *B61F 11/00* (2013.01); *B61F 9/00* (2013.01)

(58) Field of Classification Search
CPC ..... B61F 9/00; B61F 11/00
See application file for complete search history.

(56) References Cited

U.S. PATENT DOCUMENTS

| | | | | |
|---|---|---|---|---|
| 166,301 | A | 8/1875 | Root | |
| 840,733 | A | 1/1907 | Anderson | |
| 952,781 | A | 4/1910 | Edwards | |
| 1,626,610 | A | 5/1927 | Norquist | |
| 2,227,733 | A | 1/1941 | McCormick et al. | |
| 2,431,062 | A | 11/1947 | McCormick et al. | |
| 2,930,329 | A * | 3/1960 | Busch | B61F 5/06 104/242 |

* cited by examiner

*Primary Examiner* — Robert J McCarry, Jr.
(74) *Attorney, Agent, or Firm* — Law Office of John W. Harbst

(57) ABSTRACT

A system for containing derailment of a railway vehicle from rails over which the railway vehicle moves. The derailment system includes a derailment apparatus provided on each side frame of the railway vehicle. In one instance, each derailment apparatus has inner and outer laterally spaced and free ended depending arms disposed above a head section of the rails as long as the railway vehicle wheels ride on the rails. In the event either wheel becomes derailed, one the rails is received and accommodated within a pocket defined by the respective derailment apparatus. When a derailment occurs, the depending arms of the derailment apparatus extend below and to opposed sides of the head section of a rail received and accommodated in the pocket of the respective derailment apparatus whereby inhibiting total derailment of the railway vehicle from the rails over which the railway vehicle is traveling.

20 Claims, 17 Drawing Sheets

SYSTEM FOR CONTAINING DERAILMENT OF A RAILWAY VEHICLE

RELATED APPLICATION

This application claims priority under 35 U.S.C 119 to U.S. Provisional Patent Application Ser. No. 62/166,679 filed May 26, 2015 and entitled DERAIL RETAINER, the entirety of which is incorporated herein by reference.

FIELD OF THE INVENTION DISCLOSURE

The present invention disclosure generally relates to a railway vehicle and, more specifically, to a system for containing derailment of a railway vehicle.

BACKGROUND

Each end of a railway vehicle typically includes two wheel and axle assemblies journalled for rotation in bearings between a pair of laterally spaced side frame members. One end of each axle assembly is rotatably carried by a journal box mounted on one of the side frames. A laterally elongated bolster also extends between and is supported by the side frames. A body of the railway vehicle is supported on the bolster. Wheels are fit onto axles of each assembly so as to allow the railway vehicle to ride over rails or tracks between locations. Toward the inner sides thereof, each wheel is provided with a radial flange which operably engages one side of the respective rail or track to inhibit excessive lateral displacement of the trucks thus keeping the trucks and railway vehicle on the rails or tracks.

Rails and railbed conditions can be compromised due to weather, temperature changes and a myriad of other factors. Other serious hazards in railroad operations today involve wheel and bearing failures. When these failures occur and/or are encountered, the wheel and side frame member adjacent to the affected parts can drop off its rail toward the outside of the roadbed, often causing derailment not only of the railway vehicle in distress but also the railway vehicles coupled thereto and which follow. In many cases of derailments due to a broken rail or wheel/bearing failure, the rail and side frame components on the side opposite from the derailed wheel remain stable but drop off toward the inside of rail and toward the roadbed.

The damages resulting from a derailment can involve the train itself as well as the surrounding areas. Moreover, the extent of the damages can vary widely as a result of train behavior following a train derailment. The lateral spacing between the rails over which the railway vehicle travels is relatively narrow. In derailments in which the railway vehicle completely departs from the rails, and because of its momentum together with the pushing action of any coupled vehicles which follow, the railway vehicle can continue along its general path of travel and overturn upon itself causing significant damage to the surrounding area. Depending upon the commodity being transported in the railway vehicle, railway vehicle derailments can be detrimentally harmful to the surrounding environment.

As a result of physical constraints, as well as for cost and drainage purposes, many railbeds over which railway vehicles travel are relatively narrow and raised above the surrounding ground level with a sloping structure of rock ballast. This configuration places any derailed vehicle at a further risk of overturning upon itself as it leaves contact with the rails. In derailments in which the railway vehicle remains in close proximity to the rails, however, the railway vehicle often remains upright and the mishap frequently results in minimal damage.

In view of the above, and in accordance with the present invention disclosure, there is provided a cost effective system for inhibiting total derailment of the railway vehicle from the rails over which the railway vehicle is traveling.

SUMMARY

In view of the above, and in accordance with one aspect of this invention disclosure, there is provided a system for containing derailment of a railway vehicle from a rail system including a pair of laterally spaced rails over which the railway vehicle travels. Each rail has a base section, an upstanding middle section joined to the base section and a head section joined to the middle section and having a predetermined width. The railway vehicle has a pair of laterally spaced side frames which mount wheels carried by axles for rotation about a fixed axis. The derailment system includes a derailment apparatus provided on each side frame. The derailment apparatus has inner and outer laterally spaced and free ended depending arms disposed above the head section of the rails as long as the wheels ride on the head sections of the rails. The lateral spacing between the arms of the derailment apparatus is equal to or greater than the predetermined width of the head section on either rail to define a pocket therebetween. As such, and in the event either wheel becomes derailed, one of the rails is received and accommodated within the pocket defined by the respective derailment apparatus. In this embodiment, the depending arms of the derailment apparatus extend below and to opposed sides of the head section of a rail received and accommodated in the pocket of the respective derailment apparatus thereby inhibiting total derailment of the railway vehicle from the rails over which the railway vehicle is traveling. For example, if a railway vehicle is traveling northbound and a derailment affects the west side rail, the section of the east side rail will be received and accommodated within the pocket defined by the derailment apparatus arranged on the east side of the railway vehicle.

In a preferred embodiment, the outer arm of each derailment apparatus depends from the respective side frame a greater distance than does the inner arm of each derailment apparatus. In one embodiment, the arms of each derailment apparatus define an inner side surface for operably engaging a side of the head section of the adjacent rail when the railway vehicle wheel is derailed. In one form, a bottom edge of the inner and outer depending arms is spaced above a rail engaging portion on the head section of the rail by a distance less than a height of the rail.

In a preferred form, the system for containing derailment of the railway vehicle can furthermore include an apparatus or equipment for detecting derailment of the railway vehicle from either rail. In one form, such detecting apparatus can be electrically operated. In a preferred embodiment, the detecting equipment includes an apparatus for transmitting information to a location remote from the side frame whereat the derailment occurs.

According to another aspect of this invention disclosure, there is provided a system for containing derailment of a railway vehicle from a rail system including a pair of laterally spaced rails over which the railway vehicle travels. Each rail has a base section, an upstanding middle section joined to the base section and a head section joined to the middle section and having a predetermined width. Opposed ends of the railway vehicle are supported on the rails by a pair of trucks. Each truck includes a pair of laterally spaced side frames with wheels carried by axles for rotation about a fixed axis.

According to this aspect of the invention disclosure, the derailment system includes a derailment apparatus provided on each side frame. Each derailment apparatus has inner and outer laterally spaced and rigid free-ended arms disposed above the head section of the rails as long as the wheels ride along the rails and extending lengthwise of the respective side frame. The lateral spacing between the arms of each derailment apparatus is equal to or greater than the predetermined width of the head section on either rail. At least one of the inner arm and outer arm of each derailment apparatus has a generally horizontal and free-ended component adapted to be operably disposed beneath the head section of a rail in the event a wheel drops off a rail whereby inhibiting total derailment of the railway vehicle from the rails over which the railway vehicle is traveling.

In one form, the outer arm of each derailment apparatus depends a greater distance from the lower surface of a respective side frame than does the inner arm of each derailment apparatus. Preferably, the outer arm of each derailment apparatus extends lengthwise of the respective side frame a greater distance than does the inner arm. In one embodiment, each arm of each derailment apparatus defines an inner surface for operably engaging a side surface of the head section of a rail accommodated between the arms in the event a wheel drops off a rail. To further contain derailment of the railway vehicle from the rail system the inner surfaces defined by the inner and outer arms of each derailment apparatus angularly diverge relative to each other along at least a portion of their lengths.

In a preferred form, the outer arm of each derailment apparatus has a generally L-shaped configuration, with a lower and free end of the outer arm extending laterally inward toward the adjacent wheel on the railway vehicle. In another embodiment, the outer arm of each derailment apparatus has a generally vertical section attached to and depending from one of the side frames and a generally horizontal free-ended section extending laterally from the vertical section and toward an adjacent wheel on the railway vehicle. Preferably, the horizontal component on either arm of each derailment apparatus is movably connected to a remainder of the arm. In this form, the movable horizontal component is biased into position relative to the remainder of the respective arm.

According to another aspect of this invention disclosure, there is provided a system for containing derailment of a railway vehicle from a rail system including a pair of laterally spaced rails over which the railway vehicle travels. Each rail has a base section, an upstanding middle section joined to the base section and a head section joined to the middle section and having a predetermined width. Each rail further defines two downwardly disposed shoulders on opposite lateral sides of the middle section. The railway vehicle is supported for movement over the rails by a pair of longitudinally spaced trucks. Each truck includes a pair of laterally spaced side frames with wheels carried by axles for rotation about a fixed axis.

According to this aspect of the invention disclosure, the derailment system includes a derailment apparatus on each side frame. The derailment apparatus has a free-ended arm depending from each side frame. A free end of the arm is disposed above the head section of each rail and laterally outward from the respective wheel as long as the wheels ride along the rails. The arm on the derailment apparatus has a generally horizontal free-ended component which, upon a derailment, is adapted to be operably disposed below the head section of one of the rails in a position to operably engage with one of the downwardly disposed shoulders on one of the rails thereby inhibiting total derailment of the railway vehicle from the rails over which the railway vehicle is traveling.

In this embodiment, the arm of each derailment apparatus defines a side surface for operably engaging a side of the head section of the adjacent rail when one of the wheels drops off a rail. In one embodiment, the arm of each derailment apparatus has an open-sided generally hook-like configuration which preferably opens toward an adjacent wheel on said railway vehicle. In another embodiment, the arm of each derailment apparatus has a generally L-shaped configuration, with a lower end of the arm extending laterally inward toward the adjacent wheel on the wheel. In still another embodiment, the arm of each derailment apparatus has a generally vertical section attached to and depending from a respective side frame and a generally horizontal section extending laterally from the vertical section and toward a wheel on the railway vehicle. Preferably, the horizontal component on the arm of each derailment apparatus is movably connected to a remainder of the arm. In this embodiment, the movable horizontal component on the arm of each derailment apparatus is biased into position relative to the remainder of the arm.

DETAILED DESCRIPTION

Figure 1:
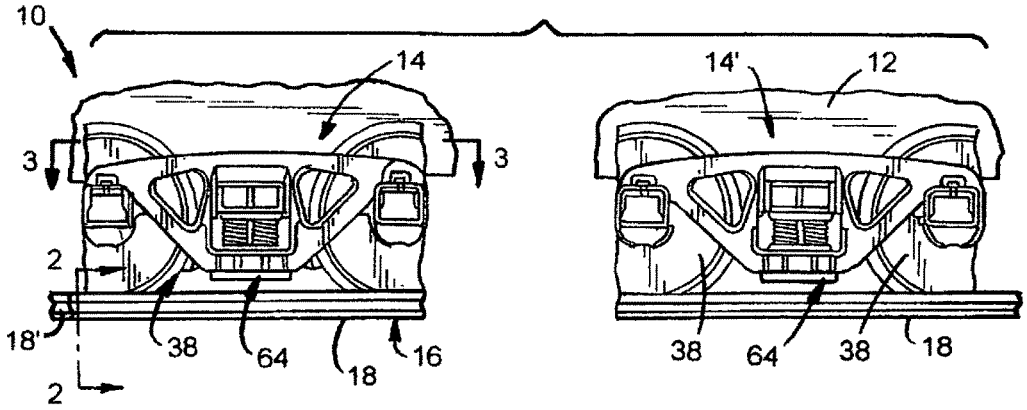
FIG. 1 is a fragmentary side elevational view of a railway vehicle having railway vehicle trucks arranged toward opposite ends thereof.

While this invention disclosure is susceptible of embodiment in multiple forms, there is shown in the drawings and will hereinafter be described preferred embodiments, with the understanding the present disclosure is to be considered as setting forth exemplifications of the disclosure which are not intended to limit the disclosure to the specific embodiments illustrated and described.

Referring now to the drawings, wherein like reference numerals indicate like parts throughout the several views, FIG. 1 shows a railway vehicle 10 including a railway vehicle body 12. As used herein and throughout, the term or phrase "railway vehicle" means and refers to locomotives, self-propelled rail, i.e., passenger vehicles, as well as railroad freight cars and the like which move over rails. As is known, the vehicle body 12 is supported, toward opposite ends thereof, in operable combination with a pair of wheeled trucks 14 and 14' for movement over a rail system 16 including a pair of laterally spaced and generally parallel rails or tracks 18, 18'.

Figure 2:
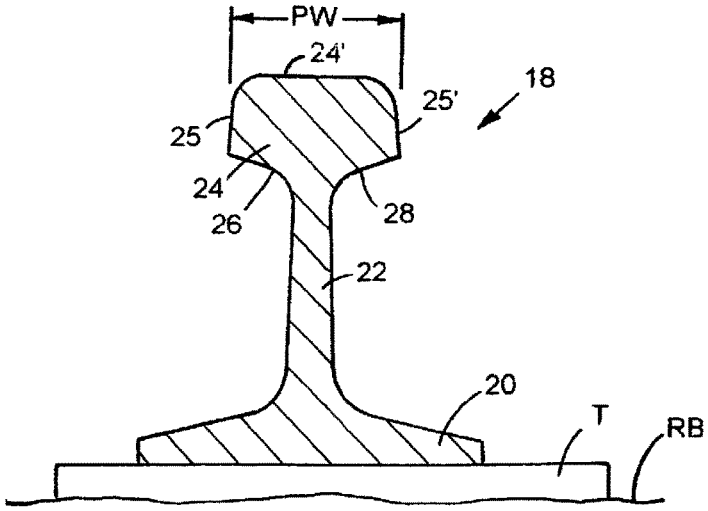
FIG. 2 is an enlarged sectional view of a rail taken along line 2-2 of FIG. 1.

The rails or tracks over which the railway vehicle 10 travels are of a conventional design and, as shown in FIG. 2, each include a base section 20, an upstanding middle section 22 joined to the base section 20 and a head section 24 joined to the middle section 22. When arranged on a railbed RB, the base section 20 of each rail is secured to a conventional tie or the like T. Preferably, each rail or track is of unitary construction. Moreover, the head section 24 of each rail 18 has a wheel engaging surface 24' and laterally spaced sides 25, 25' defining a predetermined width PW therebetween. The predetermined width of the head section 24 is generally greater than the predetermined width of the middle section 22. As such, the head section 24 of each rail defines two downwardly facing shoulders 26 and 28 on opposite lateral sides of the middle section 22 in the area where the middle section 22 is joined to the head section 24.

The wheeled trucks 14, 14' are substantially similar to each other and, thus, only wheeled truck 14 will be described in detail, Turning to FIG. 3, each railway vehicle truck includes, in general, a pair of laterally spaced side frames 30, 30' with a bolster 32 laterally extending between and operably supported by the side frames 30, 30'. The side frames 30, 30' also serve to mount a wheel and axle assembly 34 to opposite sides of the bolster 32. Each wheel and axle assembly 34 includes an axle 36 which rotates about a fixed axis 37. Moreover, each wheel and axle assembly 34 includes a pair of laterally spaced wheels 38, 38' toward opposed ends of each axle 36. As is conventional, each wheel 38, 38' has a radial flange 39 which, during movement of the railway vehicle 10, cooperates with the head section 24 of the adjacent rail or track to guide and limit lateral movements of the railway vehicle 10.

The side frames of each truck are substantially mirror images of each other and, thus, only the side frame 30 will be described in detail. Each side frame is preferably of one-piece construction and, as is conventional, is formed from cast steel. In the embodiment illustrated by way of example in FIG. 4, each side frame includes an upper cambered compression member 40 and a lower tension member 42 which merges at its ends into the ends of the compression member 40. Each side frame also includes roller bearings or journal boxes 44, 44' for the wheel axles 36 (FIG. 3) of each wheel and axle assembly 34 (FIG. 3). Generally upright struts 46 are located between the compression member 40 and tension member 42 and define therebetween a center bolster opening 48. Window openings 50, 50' flank the bolster opening 48.

Figure 4:
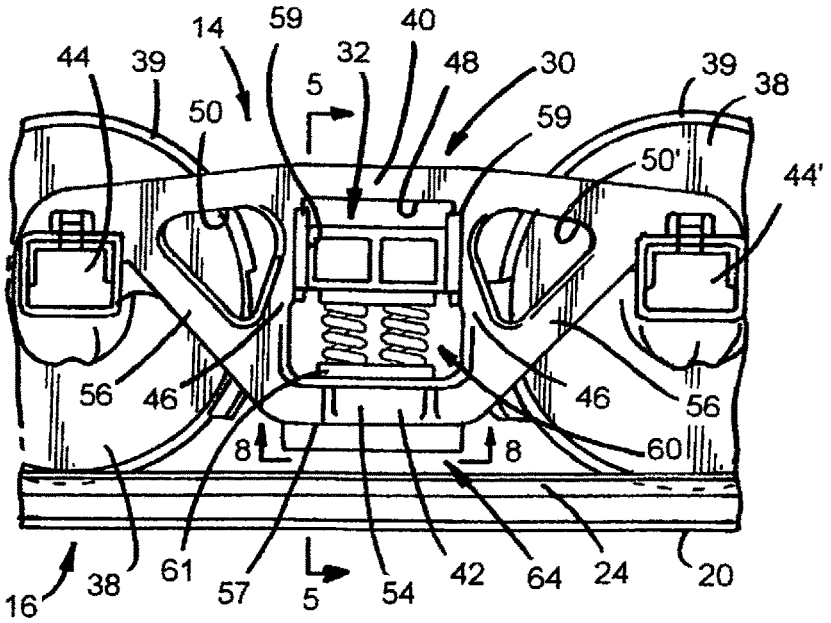
FIG. 4 is an enlarged side elevational view of a side frame forming part of each railway vehicle truck.

In the embodiment illustrated by way of example in FIG. 4, the tension member 42 of each side frame has a middle generally horizontal section or chord 54 disposed below the bolster opening 48 and side sections 56 diverging upwardly from the ends of the middle section 54 and inclined toward the ends of the compression member 40 where they merge therewith. In a preferred embodiment, the middle section 54 of the tension member 42 of each side frame has a generally rectangular cross-sectional configuration and defines a generally flat bottom wall or section 57 extending longitudinally for a majority of the length of the middle section 54.

The ends of the bolster 32 extend or project through the bolster opening 48 in the side frames and past the sides of the upstanding struts 46. Each upstanding strut 46 is provided with a guide portion 59 adapted for sliding engagement with a side of the bolster 32. As is conventional, the ends of the bolster 32 are supported on a spring package or assembly 60 which rests in nests 61 supported by the horizontal middle section 54 of the tension member 42 of each side frame. The railway vehicle truck construction heretofore described is generally conventional and well known in the art.

If a railway vehicle wheel should break or if bearing 44 should burn-out or otherwise fail, the end of the side frame 30, 30' adjacent to this wheel or axle being unsupported, as well as the wheel on the opposite side of the railway vehicle can drop or fall onto the road bed RB. Such a happening can cause a derailment of the railway vehicle 10.

Accordingly, and in accordance with this invention disclosure, there is provided a system 64 for containing derailment of the railway vehicle 10 from the rail system 16 (FIG. 1) when and if this happening should occur. System 64 includes a derailment apparatus 66 provided on each side frame 30, 30'. In the illustrated embodiment, each derailment apparatus 66 is formed from a rigid material i.e, steel or the like and is secured to the middle section 54 of the tension member 42 of each side frame as by welding and/or fasteners and/or other suitable connectors or it can be cast integral with the respective side frame. Preferably, each derailment apparatus can be formed from any of a myriad of non-sparking materials. In the preferred embodiment, each derailment apparatus is formed from a rigid material, steel or the like, having a hardness which can be greater than, equal to, or less than the hardness of the steel used to form the rails 18, 18'. Suffice it to say, the derailment apparatus 66 provided on each side of the side frame is a mirror image of the other.

The derailment apparatus 66 provided on each side frame is configured such that when either side frame 30, 30' (FIG. 3) falls from the respective rail, for failure of adequate support, one derailment apparatus 66 drops upon and captures a lengthwise segment of the adjacent rail. In the form illustrated by way of example in FIGS. 5 and 6, each derailment apparatus 66 is formed separate from and adjustably secured to the respective side frame.

Figure 5:
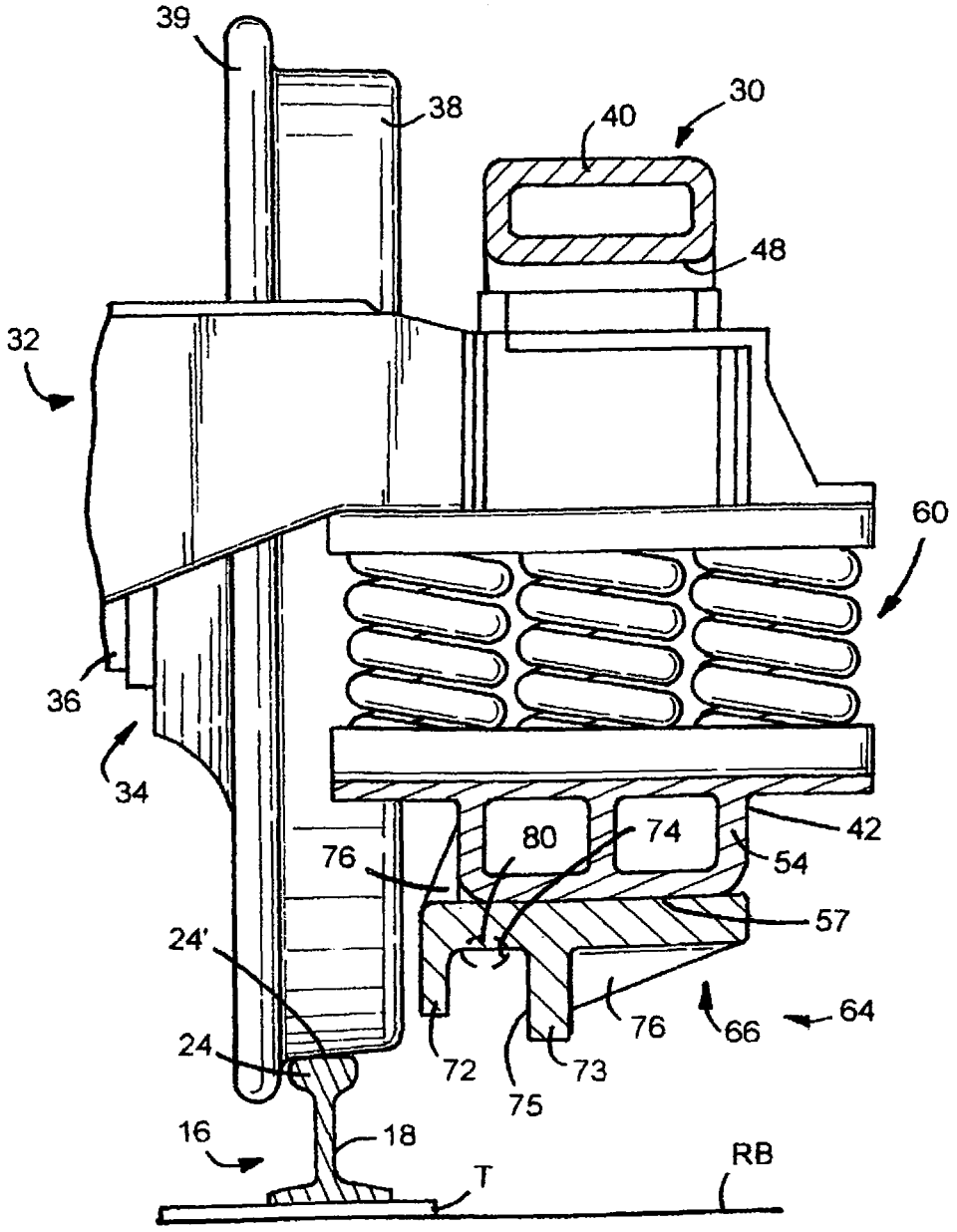
FIG. 5 is an enlarged sectional view taken along line 5-5 of FIG. 4 showing the relative positions of a wheel, railway vehicle side frame and derailment apparatus when the wheel is on the rail.
Figure 6:
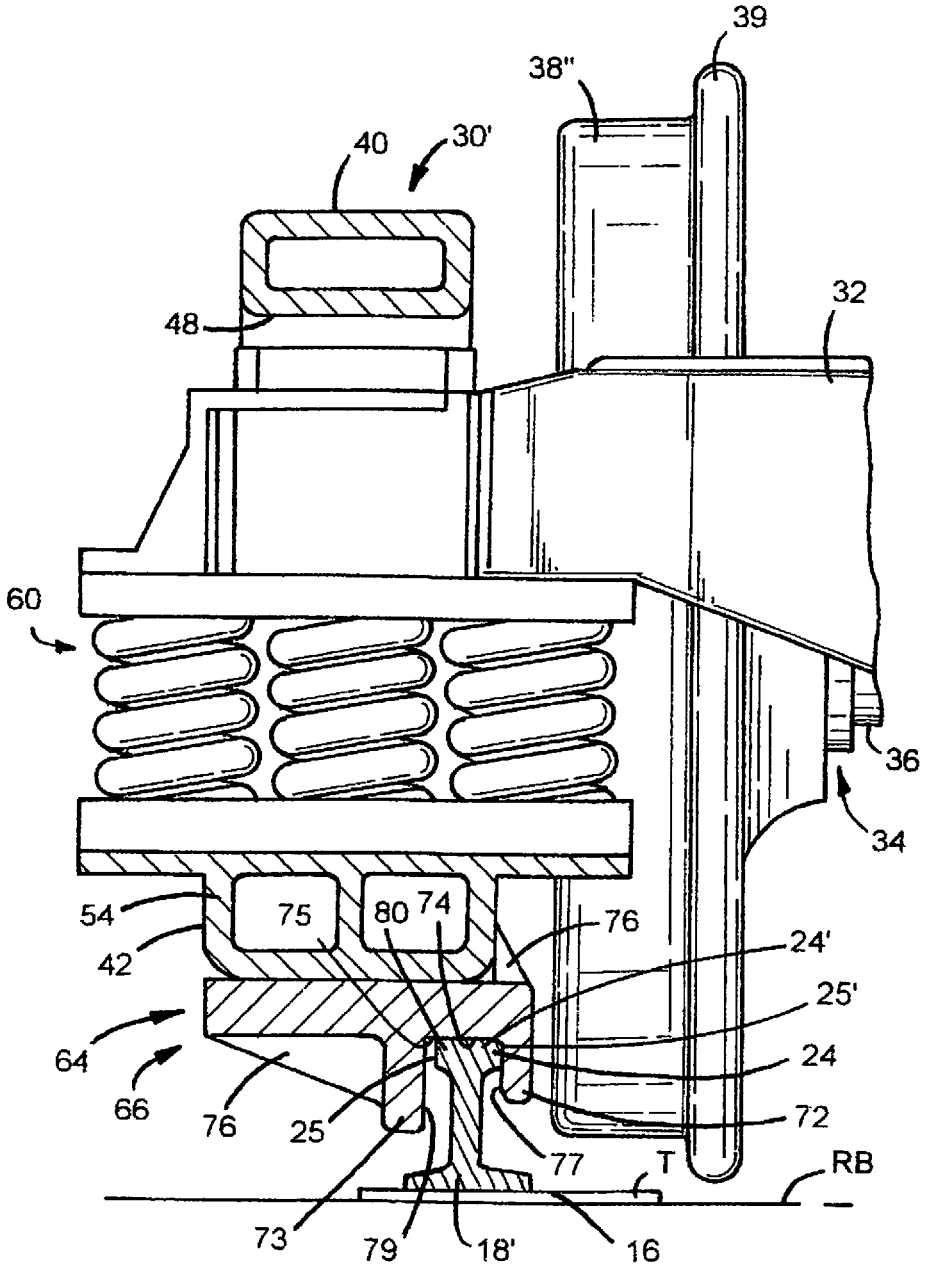
FIG. 6 is an enlarged sectional view similar to FIG. 5 illustrating the relative positions of a wheel opposed to that illustrated in FIG. 5, a railway vehicle side frame and derailment apparatus when the wheel in FIG. 5 derails.

In the embodiment illustrated by way of example in FIGS. 5 and 6, each derailment apparatus 66 has free-ended inner and outer laterally spaced, vertically extending rigid arms 72 and 73, respectively, which depend from a top wall or surface 74 defined by either the respective side frame 30, 30' or apparatus 66. The lateral spacing between the arms 72, 73 is equal to or greater than the predetermined width PW (FIG. 2) of the head section 24 on either rail 18, 18' and serves to define an open-bottom pocket 75 therebetween and which is open at opposite ends thereof. As illustrated in FIG. 5, each apparatus 66 is configured such that the free-end or bottom edge of each arm 72, 73 is positioned above the wheel engaging surface 24' on the head section 24 of the adjacent rail a sufficient distance to enable it to clear all rail or track accessories as long as the adjacent wheel is on the rail.

Preferably, the distance the free-end or bottom of each arm 72, 73 is positioned above the wheel engaging surface 24' on the head section 24 of the adjacent rail is less than the height of the wheel engaging surface 24' of each rail 18, 18' above the railbed RB. Accordingly, and in the event of a derailment, the apparatus 66 associated with each side frame 30, 30' drops toward the road bed and the rail opposite the derailed wheel is received and accommodated within the pocket 75 defined by the respective apparatus 66. As the derailed wheel continues to ride or roll along the railbed RB (FIG. 6) following a derailment, and in those embodiments so configured, surface 74 of the respective derailment apparatus will preferably engage with the wheel engaging surface of the head section 24 of the rail entrapped within the derailment apparatus. As such, the respective derailment apparatus can tend to furthermore lend a braking function to the derailed vehicle and assist in controlling derailment of the railway vehicle 10.

In one instance, wheel 38 can derail to the right of rail 18 as shown in FIG. 6. As such, the entire wheel and axle assembly 34 will likewise shift to the right as shown in FIG. 6. As such, and as shown in FIG. 6, wheel 18' will be forcibly derailed and the apparatus 66 associated with the opposed side frame 30' will drop toward the roadbed RB with the rail adjacent to the derailed wheel 38' being received and accommodated within the pocket 75 defined by the respective apparatus 66. As illustrated in FIG. 6, each apparatus 66 is configured such that the free-end or bottom edge of each arm 72, 73 is disposed below the head section 24 of the respective rail upon a derailment. In a preferred embodiment, and upon a derailment of wheel 38' as shown in FIG. 6, the top wall 74 partially defining the pocket 75 will engage wheel engaging surface 24' of rail 18'. It will be appreciated, however, the pocket 75 of each apparatus 66 can be designed such that the upper surface 74 partially defining pocket 75 can be vertically spaced from the wheel engaging surface 24' when rail 18' is captured therein without detracting or departing from the spirit and novel scope of this invention disclosure.

As further illustrated in FIG. 6, and upon a derailment, the arms 72, 73 of apparatus 66 associated with the side frame 30' will drop toward the rail 18' to receive and accommodate the rail 18' within the pocket 75 of apparatus 66. With the rail 18' accommodated within the pocket 75 defined by apparatus 66 on side frame 30', inner surfaces 77 and 79 on arms 72, 73, respectively, will engage the lateral sides 25', 25 (FIG. 2) of the head section 24 of the rail, thus, inhibiting excessive lateral movement and/or displacement of the respective railway vehicle truck 14, 14' (FIG. 1) upon derailment. In the example illustrated in FIG. 6, and upon a derailment, the wheels will be permitted to run along the roadbed RB, with the respective rail 18' being captured in the pocket 75 and between the arms 72, 73 of the derailment apparatus 66. In the illustrated embodiment, suitable brackets or gussets 76 are preferably arranged in operable combination with the depending arms 72, 73 on apparatus 66 to strengthen and add rigidity as well as support to each of the depending arms 72, 73.

Figure 7:
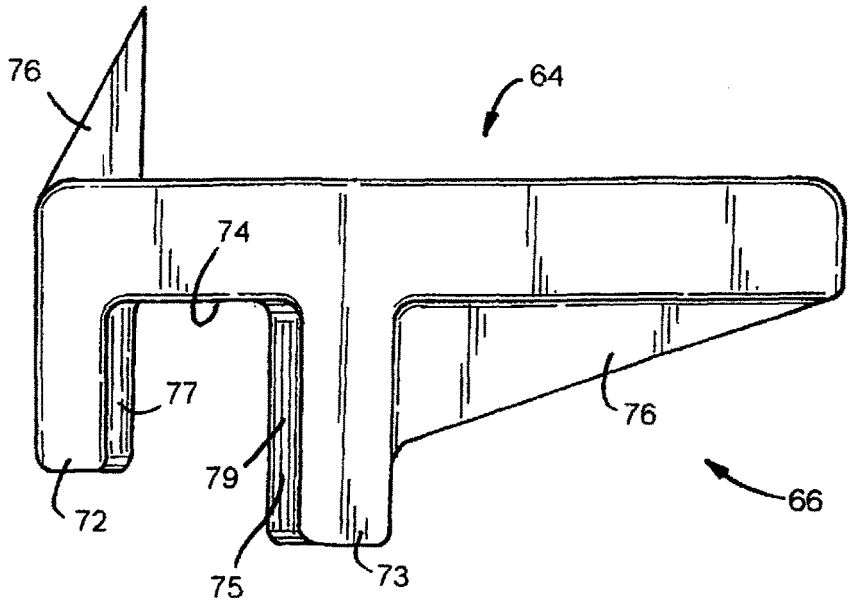
FIG. 7 is an enlarged end view of one form of derailment apparatus embodying features and principles of this invention disclosure.

A preferred form of apparatus 66 is further illustrated in FIG. 7. In the embodiment illustrated in FIG. 7, the outer arm 73 of the derailment apparatus 66 depends from the top wall or surface 74 on apparatus 66 or the respective side frame a greater distance than does the inner arm 72 of each derailment apparatus 66. Moreover, in the preferred embodiment shown in FIG. 8, the outer arm 73 of each derailment apparatus 66 extends lengthwise of the respective side frame a greater distance than does the inner arm 72.

Figure 8:
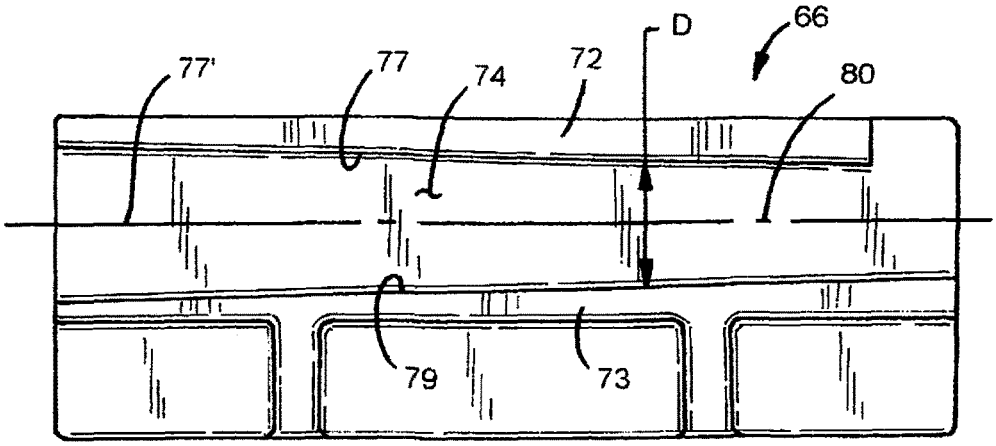
FIG. 8 is an enlarged plan view taken along line 8-8 of FIG. 4.

Moreover, in the preferred embodiment illustrated by way of example in FIGS. 7 and 8, the inner arm 72 defines an inner surface 77 extending the length of arm 72 while the outer arm 73 of each apparatus 66 also defines an inner surface 79 extending the length of arm 73. Notably, and after the derailment apparatus 66 drops down on the rail opposite the derailed wheel, the inner surfaces 77 and 79 of the arms 72 and 73, respectively, at least partially defining the pocket 75 of apparatus 66, are adapted to engage and ride along the sides 25, 25' (FIG. 2), respectively, of the head section 24 of the rail while the top wall or surface 74, at least partially defining the pocket 75 of apparatus 66, can preferably engage surface 24' on the rail. Along their lengths, the inner surfaces 77 and 79 are laterally separated by a distance D equal to or greater than the predetermined width of the head section of each rail 18, 18'.

Figure 3:
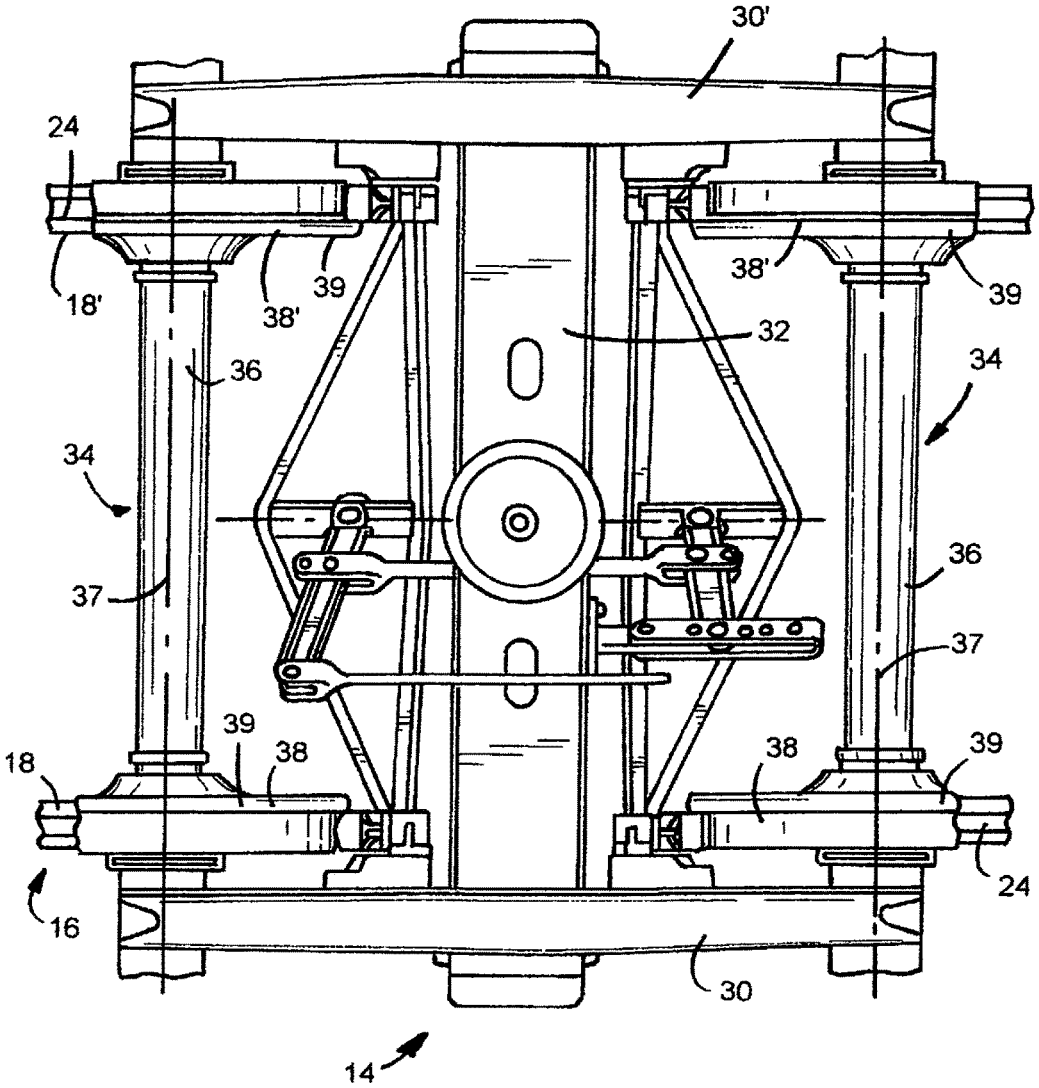
FIG. 3 is an enlarged plan view of a railway vehicle truck taken along line 3-3 of FIG. 1.

In a preferred form illustrated by way of example in FIG. 8, the pocket 75 defined by the downwardly depending arms 72, 73 and top wall 74 of each apparatus 66 has a longitudinally elongated axis 77' which generally parallels an adjacent rail when apparatus 66 is provided on the side frame 18 (FIG. 3). To facilitate and promote guidance of the rail entrapped between arms 72, 73 upon a derailment of either wheel, the pocket 75 defined by each apparatus 66 can have a tapered configuration from front to back. That is, and as schematically represented in FIG. 8, respectively, the inner surfaces 77 and 79 of arms 72 and 73, respectively, angularly diverge relative to each other from front to back for at least a major portion of their respective lengths. As such, the pocket 75 has a wider inlet opening toward a front of the pocket 75 than toward a rear of the pocket 75. The wider portion of the passage or pocket 75 defined by the derailment apparatus 66 is preferably positioned in the direction the railway vehicle 10 (FIG. 1) moves. For a bidirectional railway vehicle, the inner surfaces 77 and 79 of the arms 72 and 73, respectively, can have an hour-glass configuration, in plan, relative to each other with the greater width between the inner surfaces 77 and 79 being arranged toward each end of the arms and tapering inwardly toward a middle of each arm 72, 73 and toward axis 77'.

As the derailed wheel continues to ride or roll along the railbed RB (FIG. 6) following a derailment, the tapered configuration of the pocket 75 defined by the respective derailment apparatus 66 tends to add enhanced stability to the respective side frame and, ultimately, assist in controlling derailment of the railway vehicle 10. As mentioned, in a preferred embodiment, the lateral distance D separating the inner surfaces 77 and 79 of the arms 72 and 73, respectively, (FIG. 8) is always greater than or equal to the predetermined width PW (FIG. 2) separating the side surfaces 25, 25' on the head section 24 of either rail.

As the derailed wheel continues to ride or roll along the railbed RB (FIG. 6) following a derailment, one or both of the inner surfaces 77 and 79 of arms 72 and 73, respectively, will preferably engage with the laterally spaced sides 25, 25' of the head section 24 of the rail entrapped therebetween. As such, the respective derailment apparatus tends to furthermore lend a braking function to the derailed vehicle and assist in controlling derailment of the railway vehicle 10.

Figure 9:
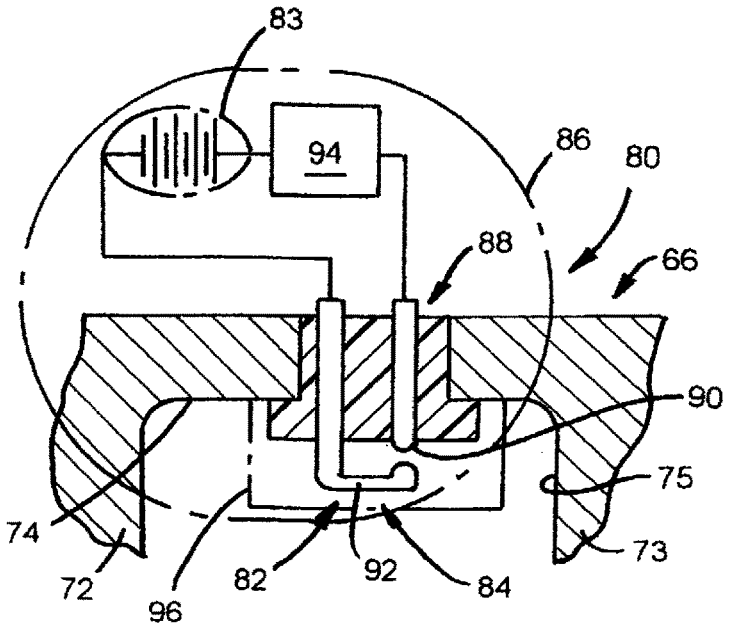
FIG. 9 is an enlarged sectional view of one form of equipment for detecting and/or sensing derailment of the railway vehicle.

In a preferred embodiment, the derailment apparatus 66 of this invention disclosure further includes equipment, generally identified in FIG. 9 by reference numeral 80, for detecting and/or sensing derailment of the railway vehicle 10 (FIG. 1) from either rail 18, 18'. The equipment 80 can be of any of a variety of different types including, but not limited to, mechanical, acoustical, optical or electrical without detracting or departing from the spirit and scope of the present invention disclosure. In one form, the equipment 80 used to effect the desired ends includes a micro-switch, a proximity switch, or other suitable mechanism and/or connection structured to facilitate detection and/or sensing derailment of railway vehicle 10 (FIG. 1) from either rail 18, 18'. Preferably, such equipment 80 provides a signal indicative of the derailment of the railway vehicle 10 from either rail 18, 18.

In the embodiment illustrated by way of example in FIG. 9, the equipment 80 is electrically operated. The source of power 83 for such electrically operated equipment 88 can be in the form of a battery and/or a photo-electric cell mounted on railway vehicle 10. Of course, other power source means are also intended to be within the scope of this invention disclosure. In one form, the equipment 80 for sensing and/or detecting a derailment of railway vehicle 10 includes a suitable sensor 84 arranged in operable combination with apparatus 66. Sensor 84 includes an open-loop circuit, schematically represented by reference numeral 86. Circuit 86 can include a switch 88 mounted in combination with apparatus 66. In the embodiment illustrated by way of example in FIG. 9, switch 88 includes a fixed contact 90 connected to the power source 83 and a movable contact 92 connected to complete the circuit to the power source 83 when contacts 90 and 92 are operably brought together. In one form, the switch contacts 90 and 92 are arranged adjacent to the top wall or surface 74 of the pocket 75 defined by apparatus 66. Of course, and with but slight redesign efforts, the switch 88 can be otherwise rearranged to detect a derailment without departing or detracting from the spirit and scope of this invention disclosure.

Intermediate the switch contacts 90 and 92, circuitry 86 includes a signal transmitter 94. To protect against inadvertent contamination and the like, the components of switch 88 are shielded and enclosed in a protective enclosure 96. Moreover, the switch contacts can be electrically insulated from the apparatus 66.

During railway vehicle operation, the circuit 86 operably associated with sensor 84 is normally open and, thus, the transmitter 94 is operably disabled. As discussed above, however, when a derailment occurs the head section 24 of the adjacent rail is received and accommodated within the pocket 75 of apparatus 66. As such, the head section 24 of the adjacent rail effectively closes the circuit 86 by forcibly and positively moving the contacts 90, 92 into engagement with each other whereby enabling or otherwise connecting the transmitter 94 to the power source 82. Thereafter, the transmitter 94 can provide a suitable signal indicative of a derailment to any one or more receivers via wired or wireless operation and whether close to apparatus 66, i.e., the railway vehicle itself, or a nearby vehicle, i.e., locomotive, or nearby railcar, a rail station or to remote locations, i.e, satellites or the like which can deliver information regarding such derailments to others. These one or more receivers can then initiate an emergency braking order.

Figure 10:
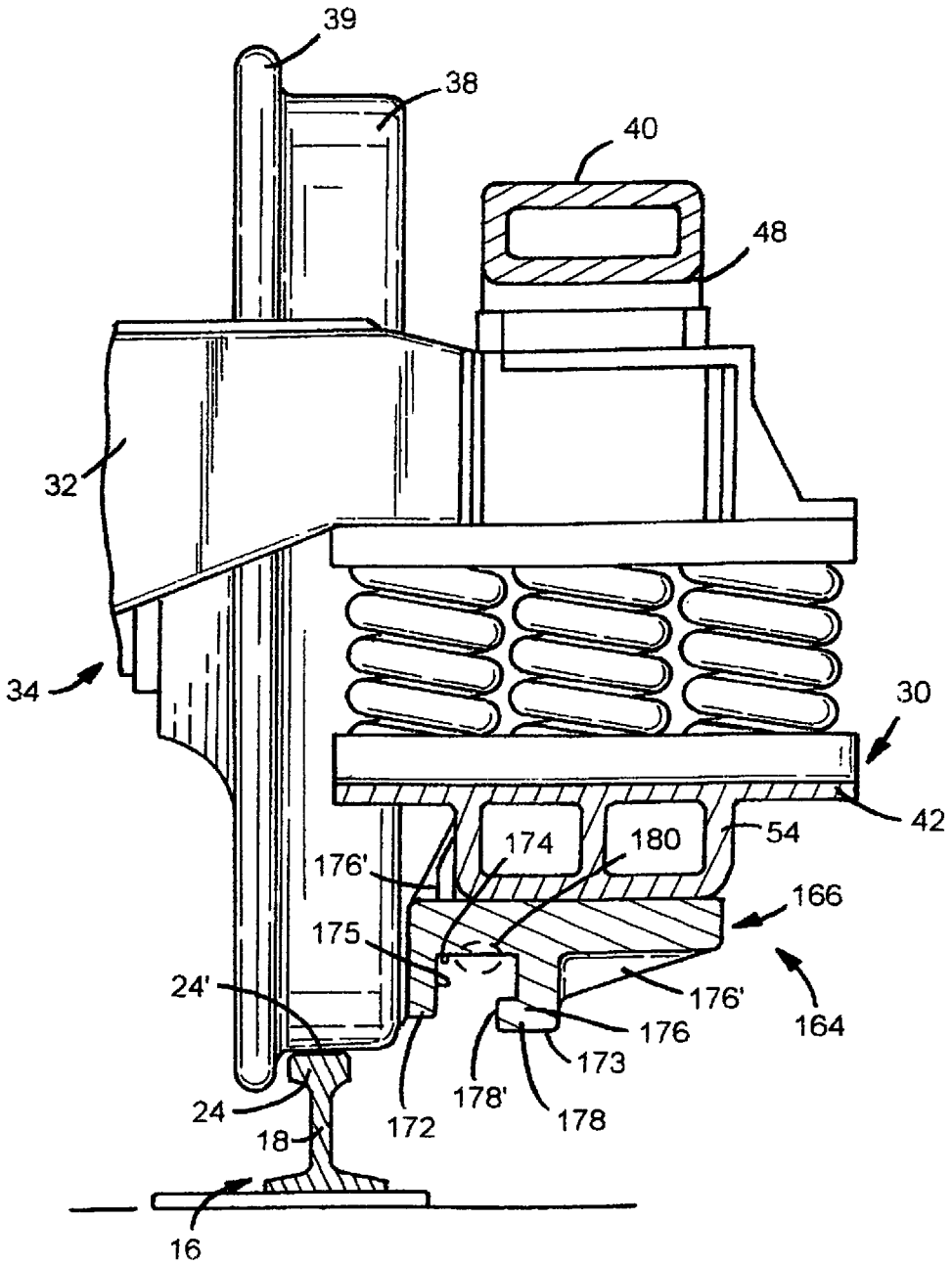
FIG. 10 is an enlarged sectional view similar to FIG. 5 but showing an alternative embodiment of a derailment apparatus embodying features and principles of this invention disclosure.

FIG. 10 illustrates an alternative form of system for containing derailment of a railway vehicle. This alternative form of apparatus is designated generally in FIG. 10 by reference numeral 166. The elements of this alternative system for containing derailment of a railway vehicle that are functionally analogous to those components discussed above regarding system 64 are designated by reference numeral identical to those listed above with the exception this embodiment uses reference numerals in the 100 series.

In the illustrated embodiment, system 164 includes a derailment apparatus 166 provided on each side frame 30, 30'. The derailment apparatus 166 provided on each side frame is a mirror image of each other. As discussed earlier regarding apparatus 66, each derailment apparatus 166 of system 164 is preferably formed from a rigid material i.e, steel or the like and is preferably secured to the middle section 54 of the tension member 42 of each side frame as by welding and/or fasteners and/or other suitable connectors or can be cast as an integral part of the respective side frame. The derailment apparatus 166 provided on each side frame is configured, such that when either side frame 30, 30' (FIG. 3) falls from the respective rail, for failure of adequate support, one derailment apparatus 166 drops upon and captures a lengthwise segment of the adjacent rail. In the form illustrated by way of example in FIGS. 10 and 11, each derailment apparatus 166 is formed separate from and adjustably secured to a respective side frame.

Figure 11:
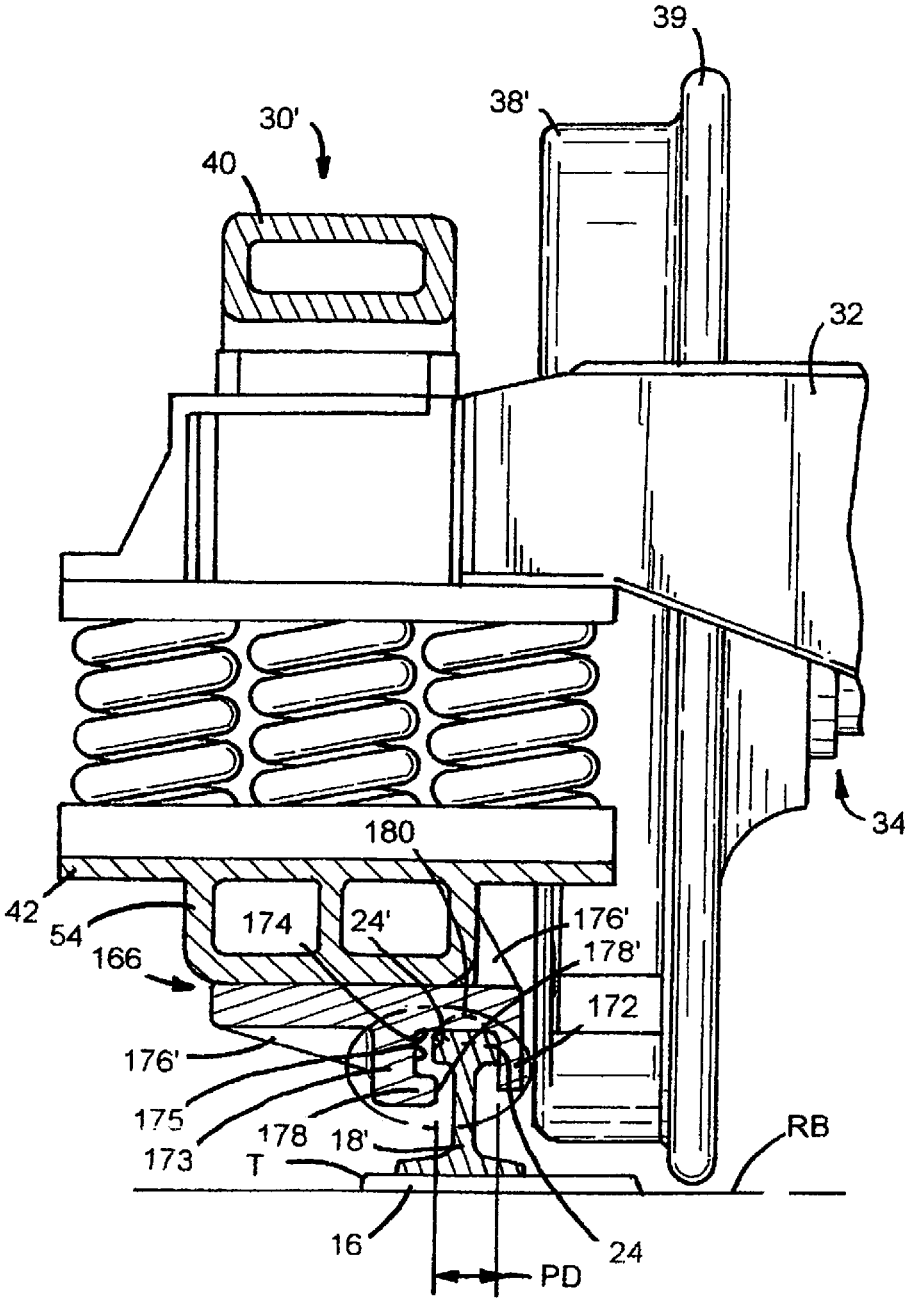
FIG. 11 is an enlarged sectional view similar to FIG. 10 illustrating the relative positions of a wheel opposed to that illustrated in FIG. 10, a railway vehicle side frame and derailment apparatus when the wheel in FIG. 10 derails.

In the alternative embodiment illustrated by way of example in FIGS. 10 and 11, each derailment apparatus 166 has free-ended inner and outer laterally spaced rigid and generally vertical arms 172 and 173, respectively, which depend from a top wall or surface 174 defined by either the side frame 30 or apparatus 166. The lateral spacing between the arms 172, 173 is equal to or greater than the predetermined width PW (FIG. 2) of the head section 24 on either rail 18, 18' and serves to define an open-bottom pocket 175 therebetween and which is open at opposite ends thereof. As illustrated in FIG. 10, each apparatus 166 is configured such that the free-end or bottom edge of each arm 172, 173 is positioned above the wheel engaging surface 24' on the head section 24 of the adjacent rail a sufficient distance to enable it to clear all rail or track accessories as long as the adjacent wheel is on the rail.

Preferably, the distance the free-end or bottom of each arm 172, 173 is positioned above the wheel engaging surface 24' on the head section 24 of the adjacent rail is less than the height of the wheel engaging surface 24' of each rail 18, 18' above the railbed RB. Accordingly, and in the event either wheel becomes derailed, the apparatus 166 associated with each side frame 30, 30' drops toward the roadbed RB and the rail adjacent to one derailed wheel is received and accommodated within the pocket 175 defined by the respective apparatus 166.

In the example illustrated in FIG. 10, wheel 38 can derail to the right of the rail 18. As such, the entire wheel and axle assembly 34 will shift to the right as shown in FIG. 10. As such, and as shown in FIG. 11, the apparatus 166 associated with the side frame 30' drops toward the railbed RB and the rail 18' adjacent to the derailed wheel 38' is received and accommodated in the open-bottom pocket 175 defined by the respective apparatus 166. As illustrated in FIG. 11, each apparatus 166 is configured such that the free-end or bottom edge of each arm 172, 173 is disposed below the head section 24 of the respective rail upon a derailment.

Figure 12:
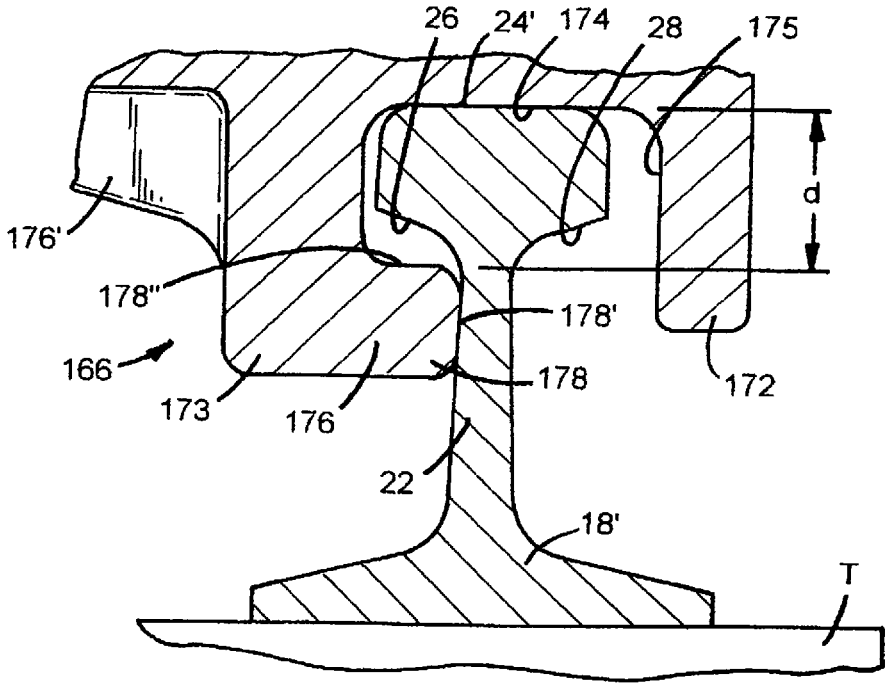
FIG. 12 is an enlarged sectional view of the area encircled in phantom lines in FIG. 11.

As shown in FIG. 12, and toward the free end thereof, at least one of the inner and outer arms 172, 173 of each apparatus 166 has a generally horizontal component 176 defined by a leg 178. When the horizontal component 176 is provided on the outer arm 173, leg 178 extends laterally inward toward the adjacent wheel. Given certain geometries of apparatus 166, when the horizontal component 176 is provided on the inner arm 172, the leg 178 can extend either laterally toward the adjacent wheel or toward the rail. For purposes of simplification, however, apparatus 166 will be hereinafter described with a leg 178 extending laterally inward toward the adjacent wheel from the outer leg 173. In one instance, the configuration of the depending arm and leg 178 lends a generally L-shaped cross-sectional configuration to the lower end of the arm 172, 173 having the leg 178 thereon. In the illustrated embodiment, leg 178 of either arm 172, 173 is formed integral with the respective arm. Alternatively, and with a slight redesign, the leg 178 can be connected to the lower depending end of either or both arms 172, 173.

Leg 178 terminates in a free end 178' which is laterally spaced from an inner surface of the opposed arm. As schematically illustrated in FIG. 10, the free end 178' of leg 178 is laterally spaced a predetermined distance PD from the inner surface of the adjacent free-ended arm of apparatus 166. Notably, the predetermined distance PD separating the free end 178' of leg 178 from the inner surface of the adjacent arm of apparatus 166 is equal to or greater than the predetermined width PW (FIG. 2) of the head section 24 of the rail such that the leg 178 will not interfere with the head section 24 of the rail (FIG. 2) being received and accommodated within the pocket 175 upon a derailment. Notably, and as schematically shown in FIG. 12, an upper surface 178" of leg 178' is vertically spaced from the upper surface 174 of the pocket 175 by a distance "d" equal to or greater than the distance separating either downwardly facing shoulder 26, 28 from the wheel engaging surface 24' on the head section 24 of either rail (FIG. 2).

As mentioned above, and upon a derailment, the arms 172, 173 of apparatus 166 associated with the side frame 30' drop toward the rail 18' to receive and accommodate a lengthwise portion of the rail 18' within the pocket 175 defined by apparatus 166 on side frame 30'. As such, the leg 178 is disposed below the adjacent downwardly facing shoulder 26, 28 on the adjacent rail. Accordingly, the free end 178' of the leg 178 can engage a side surface on the middle section 22 of the adjacent rail, thus, inhibiting excessive lateral movement and/or displacement of the respective railway vehicle truck 14, 14' (FIG. 1) while, to an extent, facilitating braking of the railway vehicle upon derailment. In the example illustrated in FIG. 11, and upon derailment of wheel 38' from rail 18', and after rail 18' is accommodated in the pocket 75 defined by apparatus 166, the top wall or surface 174 of the cavity or pocket 175 can engage with surface 24' of rail 18' whereby advantageously adding a braking function to the derailment apparatus. It will be appreciated, however, the pocket 175 of each apparatus 166 can be designed such that the upper surface 174 partially defining pocket 175 can be vertically spaced from the wheel engaging surface 24' when rail 18' is captured therein without detracting or departing from the spirit and novel scope of this invention disclosure.

In the embodiment illustrated by way of example in FIG. 11, and upon derailment, the wheel 38' will be permitted to run along the roadbed RB, with the respective rail 18' being captured in the pocket 175 and between the arms 172, 173 of the derailment apparatus 66. In the illustrated embodiment, suitable brackets or gussets 176' are preferably arranged in operable combination with the depending arms 172, 173 on apparatus 166 to strengthen and add rigidity as well as support to each of the depending arms 172, 173.

Figure 13:
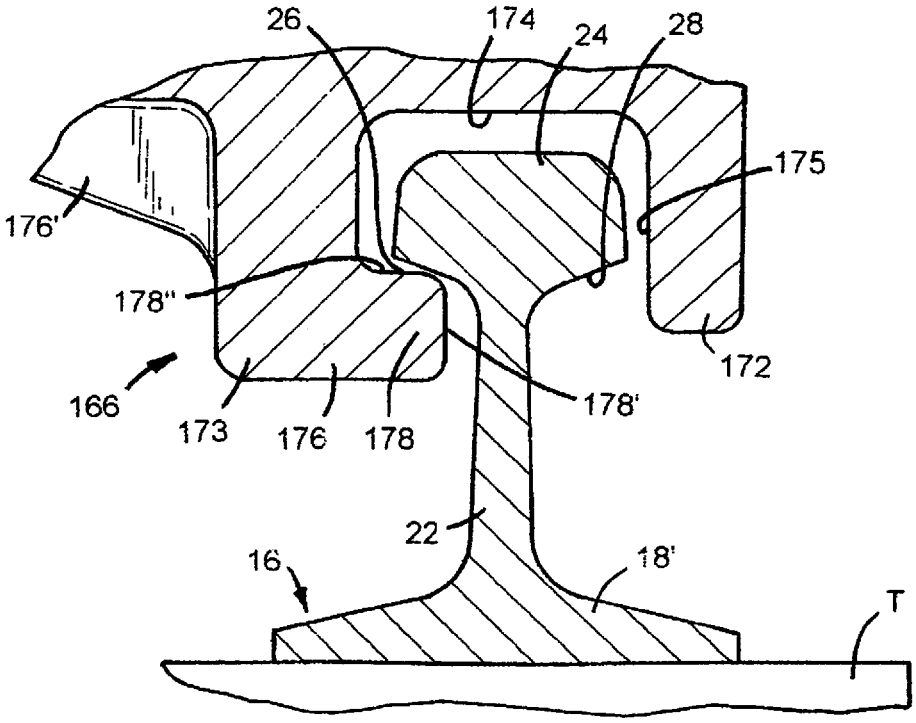
FIG. 13 is an enlarged sectional view similar to FIG. 12 showing the relative positions of the various components when a railway vehicle tends to tip in a clockwise direction upon a derailment.

As mentioned above, and for many reasons, a railway vehicle can tend to overturn upon itself as it leaves contact with the rails. In this alternative embodiment, however, and as schematically illustrated in FIG. 13, as the derailed wheel raises from the rail, the upper surface 178" of leg 178 engages the respective downwardly facing shoulder 26, 28 on the rail thereby inhibiting the railway vehicle from overturning and thereby advantageously enhancing containment of the derailment to minimize damage and economic loss.

In the embodiment illustrated in FIGS. 10 through 13, the outer arm 173 of the derailment apparatus 166 depends from the top wall or surface 174 on apparatus 166 or the respective side frame a greater distance than does the inner arm 172 of each derailment apparatus 166. Moreover, the outer arm 173 of each derailment apparatus 166 preferably extends lengthwise of the respective side frame a greater distance than does the inner arm 172.

In a preferred embodiment, the derailment apparatus 166 of this invention disclosure further includes equipment, generally indicated in phantom lines and identified in FIGS. 10 and 11 by reference numeral 180, for detecting and/or sensing derailment of the railway vehicle 10 (FIG. 1) from either rail 18, 18'. Equipment 180 can be of any of a variety of different types and arranged in various locations without detracting or departing from the spirit and scope of the present invention disclosure. In one form, equipment 180 can be of the type described above regarding equipment 80. Suffice it to say, equipment 180 provides a signal indicative of the derailment of the railway vehicle 10 from either rail 18, 18'.

Figure 14:
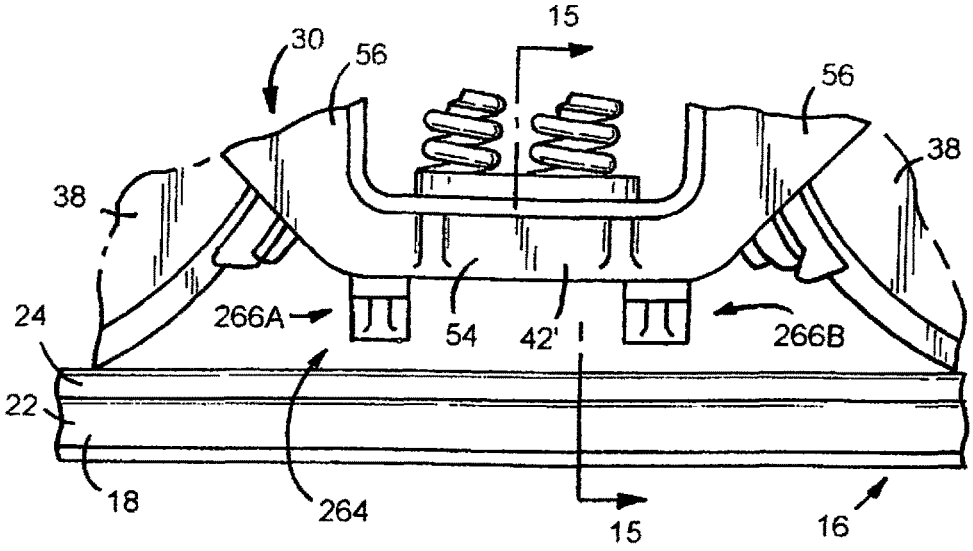
FIG. 14 is an enlarged fragmentary view of a railway vehicle side frame showing an alternative embodiment of a derailment apparatus embodying features and principles of this invention disclosure in operable combination therewith.

FIG. 14 illustrates an alternative form of system for containing derailment of the railway vehicle 10 from the rail system 16. This alternative system is designated generally in FIG. 14 by reference numeral 264. The elements of this alternative system for containing derailment of a railway vehicle that are functionally analogous to those components discussed above regarding apparatus 66 are designated by reference numeral identical to those listed above with the exception this embodiment uses reference numerals in the 200 series.

In the illustrated embodiment, system 264 includes a first derailment apparatus 266A and a second derailment apparatus 266B provided on each side frame 30, 30' (FIG. 3). The first derailment apparatus 266A and second derailment apparatus 266B are arranged in longitudinally spaced relation relative to each other on each side frame 30, 30' (FIG. 3). Moreover, and in a preferred embodiment, the first derailment apparatus 266A and the second derailment apparatus provided on side frame 30 are mirror images of the first derailment apparatus 266A and the second derailment apparatus provided on side frame 30'.

As discussed earlier regarding apparatus 66, each derailment apparatus of system 264 is preferably formed from a rigid material i.e, steel or the like. In the embodiment illustrated by way of example in FIG. 14, each derailment apparatus is secured to the middle section 54 of the tension member 42 of each side frame as by welding and/or fasteners and/or other suitable connectors or it can be cast integrally with the respective side frame. In the embodiment illustrated by way of example in FIG. 14, each derailment apparatus is preferably provided in operable combination with the respective side frame in the area where the side sections 56 diverge upwardly from the ends of the middle section 54.

Each derailment set including the first derailment apparatus 266A and second derailment apparatus 266B provided on each side frame is configured, such that when either side frame 30, 30' (FIG. 3) falls from the respective rail, for failure of adequate support, each derailment apparatus set drops adjacent one of the rails 18, 18' (FIG. 3).

Figure 15:
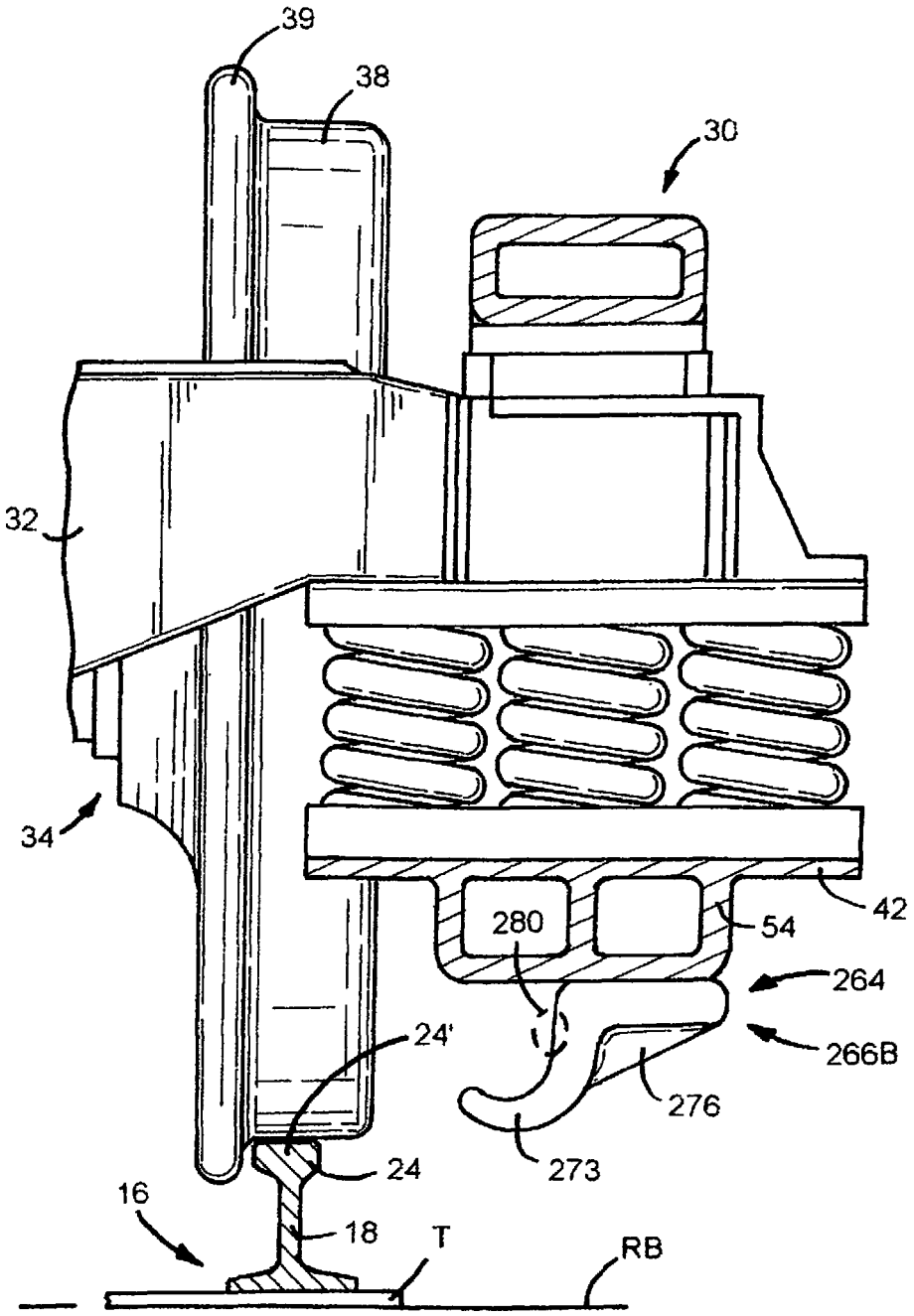
FIG. 15 is an enlarged sectional view taken along line 15-15 of FIG. 14.
Figure 16:
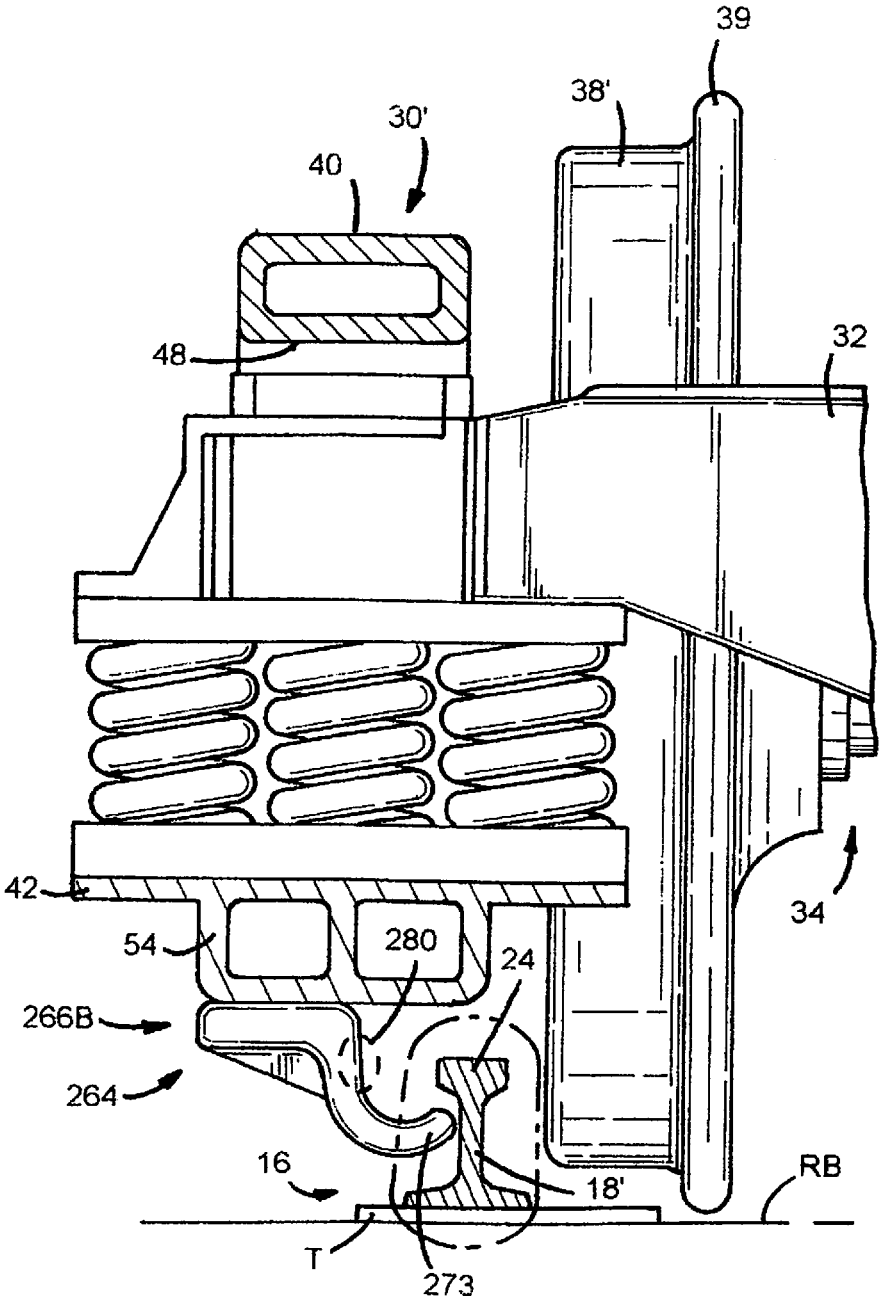
FIG. 16 is an enlarged sectional view similar to FIG. 15 illustrating the relative positions of a wheel opposed to that illustrated in FIG. 15, a railway vehicle side frame and derailment apparatus when the wheel in FIG. 15 derails.

In the embodiment illustrated by way of example in FIGS. 15 and 16, each derailment apparatus has a free-ended rigid arm 273 which depends from the respective side frame 30. As illustrated by way of example in FIG. 15, each derailment apparatus is configured such that the free-end of arm 273 is positioned above the wheel engaging surface 24' on the head section 24 of the adjacent rail a sufficient distance to enable it to clear all rail or track accessories as long as the adjacent wheel is on the rail. Moreover, and as long as the wheels 38, 38' ride along their respective rails, the free-end of arm 273 is positioned laterally outward from each respective wheel.

Preferably, the distance the free-end of arm 273 is positioned above the wheel engaging surface 24' on the head section 24 of the adjacent rail is less than the height of the wheel engaging surface 24' of each rail above the railbed RB. As such, and in the event either wheel becomes derailed, the derailment apparatus 266A and 266B of each set drops toward the roadbed RB.

Figure 17:
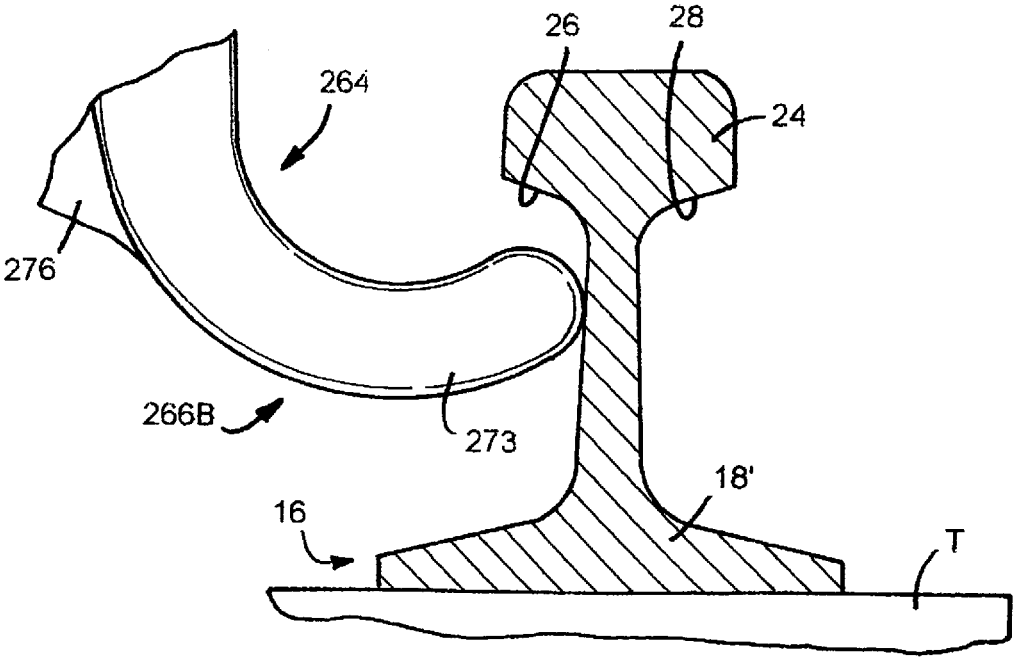
FIG. 17 is an enlarged sectional view of the area encircled in phantom lines in FIG. 16.

As shown in FIGS. 15 and 16, the arm 273 of each derailment apparatus has a generally horizontal component which is adapted to operably remain on the outer side of the adjacent rail upon a derailment. In the embodiment illustrated in FIGS. 15 through 17, the lower end of the rigid depending arm 273 has an open-sided hook configuration which opens toward an adjacent wheel 38 on the railway vehicle. Suffice it to say, and as shown in FIGS. 16 and 17, arm 273 is configured such that, upon a derailment, the free-end of arm 273 is operably disposed below or beneath the head section 24 of the adjacent rail.

In the example illustrated in FIG. 15, wheel 38 can derail to the right of the rail 18. As such, the entire wheel and axle assembly 34 will shift to the right as shown in FIG. 15. Accordingly, wheel 18' will likewise be forcibly derailed and the first and second derailment apparatus 266A and 2668 operably associated with the opposed side frame 30' will both drop toward the railbed RB. Each apparatus 266A and 266B provided on the side frames are configured such that the free end of leg 273 is disposed below the downwardly facing shoulders 26, 28 on the adjacent rail following a derailment. As such, the free end of arm 273 engages an outer side surface on the middle section 22 of the adjacent rail, thus, inhibiting excessive lateral movement and/or displacement of the respective railway vehicle truck 14, 14' (FIG. 1) while tending to add a braking function upon derailment. In the illustrated embodiment, a suitable bracket or gusset 276 is preferably arranged in operable combination with the arm 273 on each derailment apparatus 266 to strengthen and add rigidity as well as support to 273.

Figure 18:
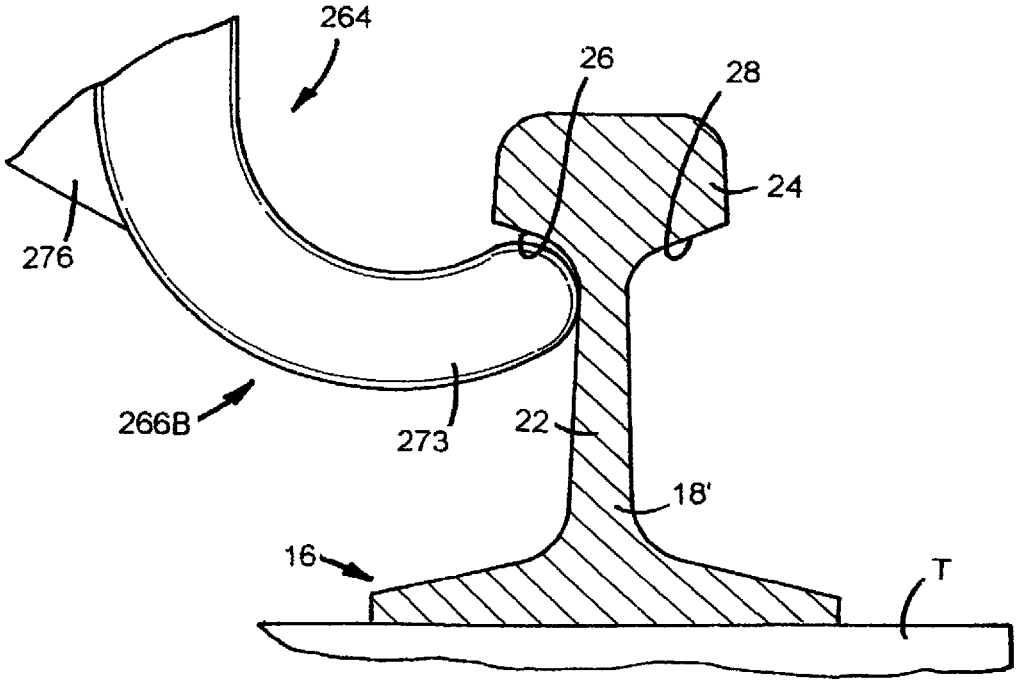
FIG. 18 is an enlarged sectional view similar to FIG. 17 showing the relative positions of the various components when a railway vehicle tends to tip in a clockwise direction upon a derailment.

As mentioned above, and for many reasons, a railway vehicle can tend to overturn upon itself as it loses contact with the rails. In the alternative embodiment shown in FIG. 18, however, and as the derailed wheel raises from the rail, the free end of arm 273 engages the respective downwardly facing shoulder 26, 28 on the rail 18' whereby inhibiting the railway vehicle from overturning and thereby advantageously enhancing containment of the derailment to minimize damage and economic loss. At the same time, the free end of arm 273 engages the respective downwardly facing shoulder 26, 28 on the rail 18' to continue to add to the braking function of each apparatus 266A and 266B.

In a preferred embodiment, either or both the derailment apparatus 266A and/or the derailment apparatus 266B can further include equipment, generally indicated in phantom lines and identified in FIGS. 15 and 16 by reference numeral 280, for detecting and/or sensing derailment of the railway vehicle 10 (FIG. 1) from either rail 18, 18'. Equipment 280 can be of any of a variety of different types and can be arranged in various locations without detracting or departing from the spirit and scope of the present invention disclosure. In one form, equipment 280 can be a conventional proximity sensor for monitoring the lateral distance between each derailment apparatus and a side surface of an adjacent wheel on the railway vehicle. Suffice it to say, equipment 280 provides a signal when the respective derailment apparatus is operably disposed within a predetermined distance of the adjacent rail indicative of derailment of the railway vehicle 10 from either rail 18, 18'.

Figure 19:
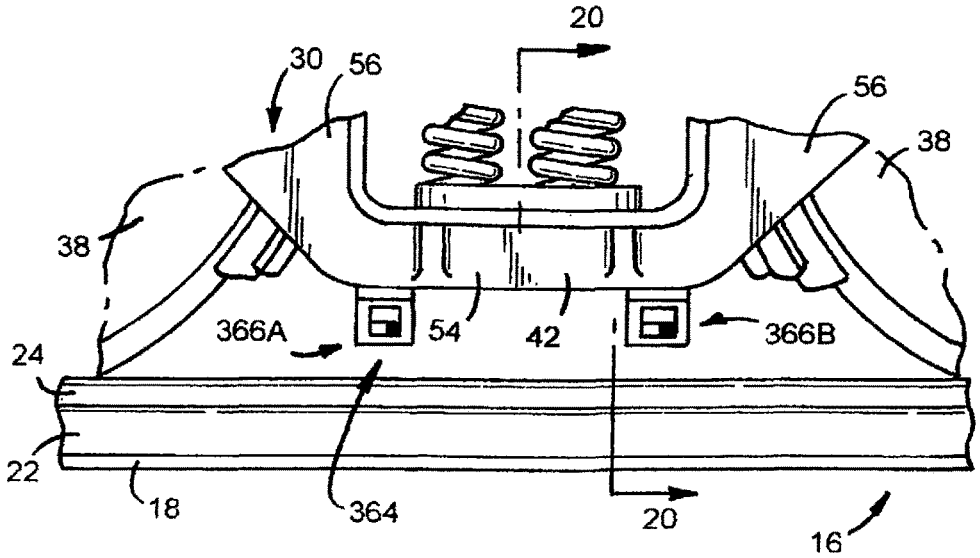
FIG. 19 is an enlarged fragmentary view of a railway vehicle side frame showing an alternative embodiment of a derailment apparatus embodying features and principles of this invention disclosure in operable combination therewith.

FIG. 19 illustrates another alterative form of system for containing derailment of the railway vehicle 10 from the rail system 16. This alternative system is designated generally in FIG. 19 by reference numeral 364. The elements of this alternative system for containing derailment of a railway vehicle that are functionally analogous to those components discussed above regarding apparatus 66 are designated by reference numeral identical to those listed above with the exception this embodiment uses reference numerals in the 300 series.

In the illustrated embodiment, system 364 includes a first derailment apparatus 366A and a second derailment apparatus 366B provided on each side frame 30, 30' (FIG. 3). The first derailment apparatus 366A and second derailment apparatus 366B are arranged in longitudinally spaced relation relative to each other on each side frame 30, 30' (FIG. 3). Moreover, and in a preferred embodiment, the first derailment apparatus 366A and the second derailment apparatus 366B provided on side frame 30 are mirror images of the first derailment apparatus 366A and the second derailment apparatus 366B provided on side frame 30'.

As discussed earlier regarding apparatus 66, each derailment apparatus 366A and 366B of system 364 is preferably formed from a rigid material i.e, steel or the like. In the embodiment illustrated by way of example in FIG. 19, each derailment apparatus is secured to the middle section 54 of the tension member 42 of each side frame as by welding and/or fasteners and/or other suitable connectors to allow for adjustments or it can be cast integrally with the respective side frame. In the embodiment illustrated by way of example in FIG. 19, each derailment apparatus is preferably provided in operable combination with the respective side frame in the area where the side sections 56 diverge upwardly from the ends of the middle section 54.

Each derailment set including the first derailment apparatus 366A and second derailment apparatus 366B provided on each side frame is configured, such that when either side frame 30, 30' (FIG. 3) falls from the respective rail, for failure of adequate support, each derailment apparatus set drops upon and captures a lengthwise segment of the adjacent rail. In the form illustrated by way of example in FIG. 19, each derailment apparatus set, including derailment apparatus 366A and second derailment apparatus 366B provided on each side frame, is formed separate from and is adjustably secured to a respective side frame.

Figure 20:
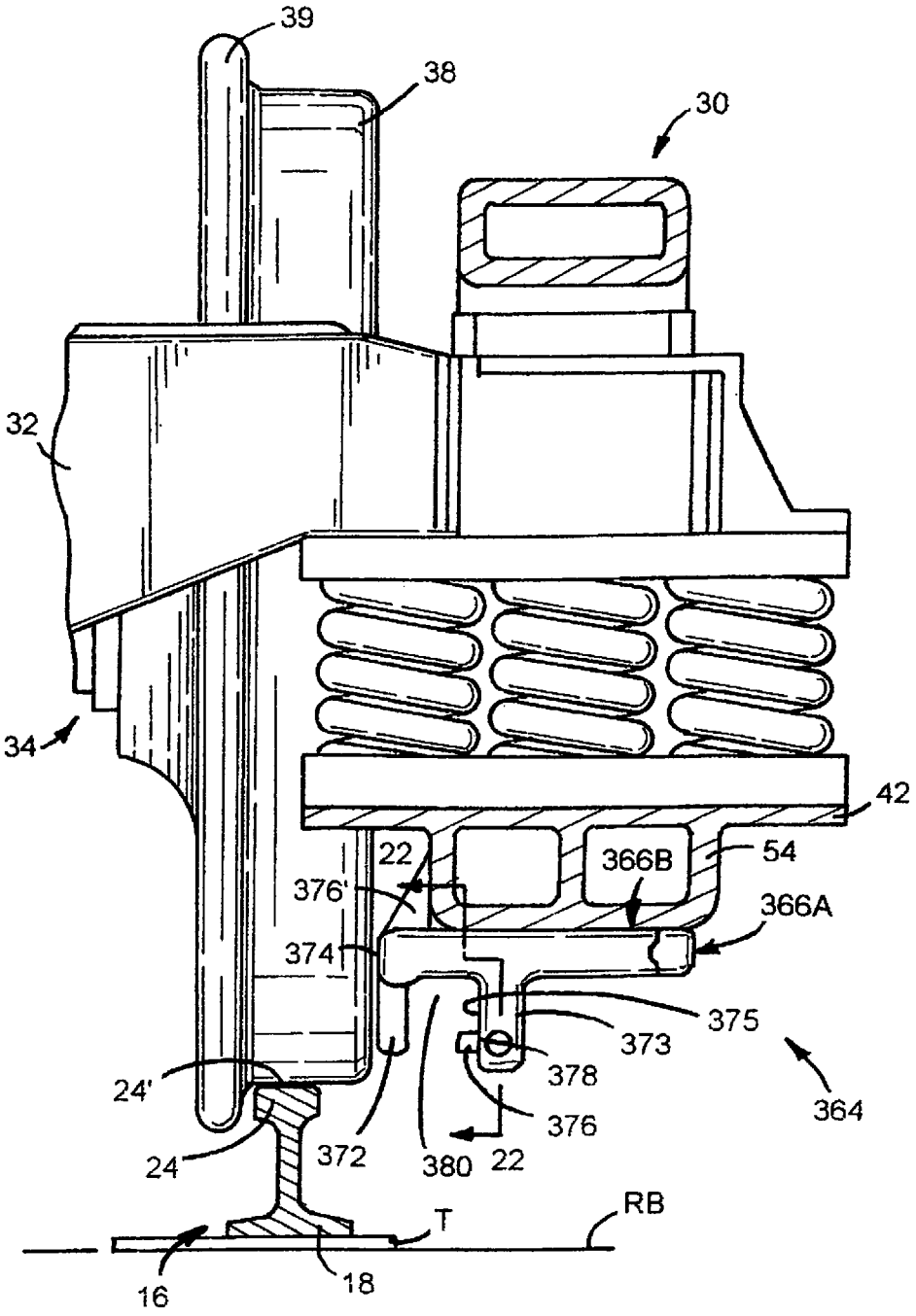
FIG. 20 is an enlarged sectional view taken along line 20-20 of FIG. 19.

Turning to the embodiment illustrated by way of example in FIG. 20, each derailment apparatus has free-ended inner and outer laterally spaced rigid and generally vertical arms 372 and 373, respectively, which, in the illustrated embodiment, depend from a top wall or surface 374 defined by either the side frame 30 or the respective derailment apparatus. The lateral spacing between the arms 372, 373 is equal to or greater than the predetermined width PW (FIG. 2) of the head section 24 on either rail 18, 18' and serves to define an open-bottom pocket 375 therebetween and which is open at opposite ends thereof. In the embodiment illustrated in FIG. 20, each derailment apparatus is configured such that the free-end or bottom edge of each arm 372, 373 is positioned above the wheel engaging surface 24' on the head section 24 of the adjacent rail a sufficient distance to enable it to clear all rail or track accessories as long as the adjacent wheel is on the rail.

Preferably, the distance the free-end or bottom of each arm 372, 373 is positioned above the wheel engaging surface 24' on the head section 24 of the adjacent rail is less than the height of the wheel engaging surface 24' of each rail above the railbed RB. Accordingly, and in the event either wheel becomes derailed, the first derailment apparatus 366A and the second derailment apparatus 366B (FIG. 19) associated with each side frame 30, 30' drops toward the roadbed RB and captures a lengthwise segment of one of the rails 18, 18' (FIG. 3) within the pocket 375.

Figure 21:
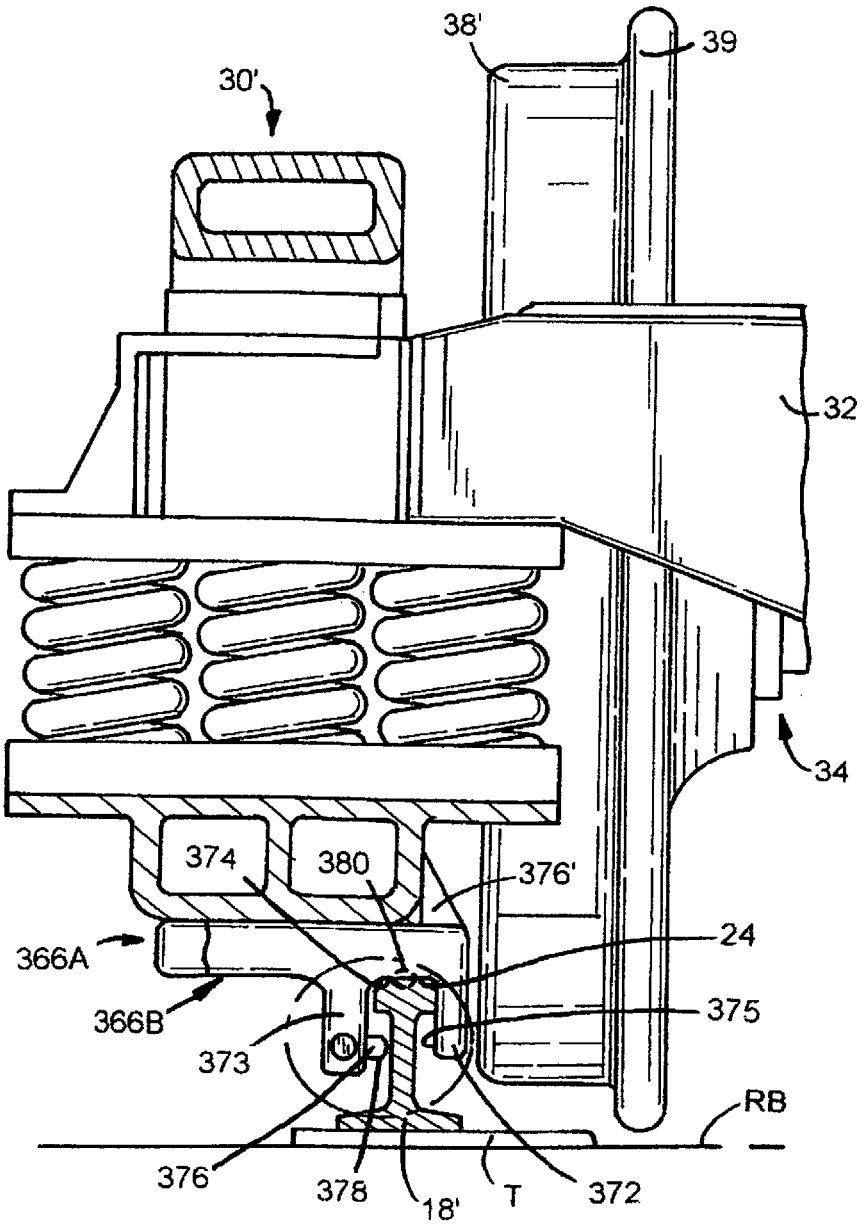
FIG. 21 is an enlarged sectional view similar to FIG. 20 illustrating the relative positions of the various components when the wheel is derailed.
Figure 22:
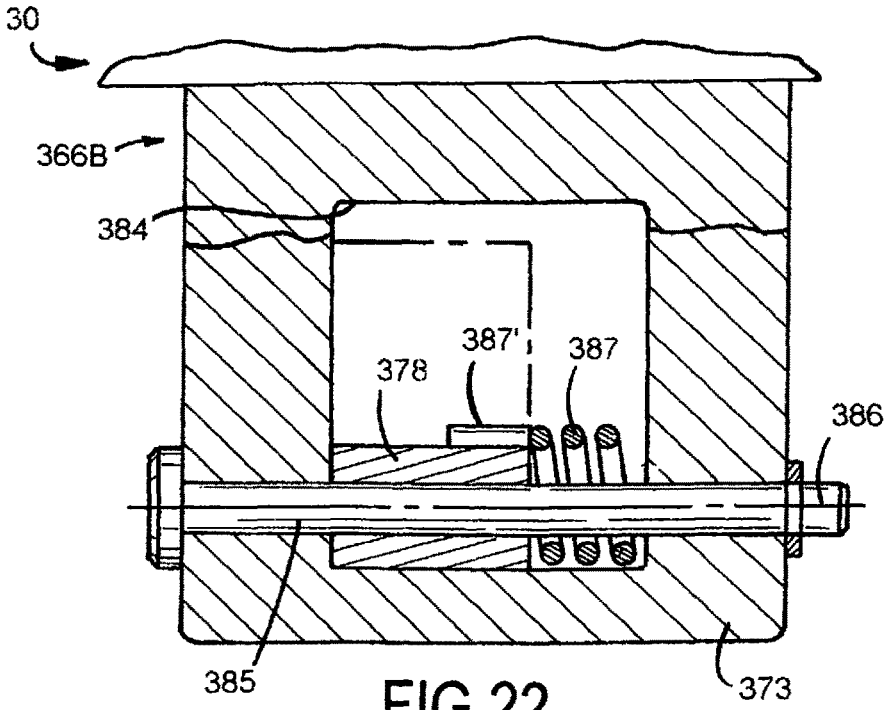
FIG. 22 is an enlarged fragmentary sectional view taken along line 22-22 in FIG. 20.

In the example illustrated in FIG. 20, wheel 38 can derail to the right of the rail 18. As such, the entire wheel and axle assembly 34 will shift to the right as shown in FIG. 20. As such, and as shown in FIG. 21, each derailment set including the first and second derailment apparatus 366A and 366B, respectively, associated with the side frame 30' drops toward the railbed RB such that rail 18' is received and accommodated in the open-bottom pocket 375 defined by the each apparatus 366A and 366B. As illustrated in FIG. 21, the derailment apparatus 366A and 366B of each derailment set is configured such that the free-end or bottom edge of each arm 372, 373 is disposed below the head section 24 of the respective rail upon a derailment.

As shown in FIGS. 20 and 21, and toward the free-end thereof, at least one of the inner and outer arms 372, 373 of each derailment apparatus 366 has a generally horizontal component 376 defined by a leg 378. As discussed above regarding that embodiment illustrated in FIG. 11, when the horizontal component 376 is provided on the outer arm 373, leg 378 extends laterally inward toward the adjacent wheel. Given certain geometries of each apparatus 366A and 366B, when the horizontal component 376 is provided on the inner arm 372, the leg 378 can extend either laterally toward the adjacent wheel or toward the rail. For purposes of simplification, however, each apparatus 366A and 366B will be hereinafter described with a leg 378 extending laterally inward toward the adjacent wheel from the outer leg 373. In one instance, the configuration of the depending arm and leg 378 normally lends a generally L-shaped cross-sectional configuration to the lower end of the arm 372, 373 having the leg 378 thereon.

In the illustrated embodiment, the horizontal component 376 of at least one of the inner and outer arms 372, 373 of each derailment apparatus is movable relative to the vertical section of the respective arm such that the horizontal component 376 can be forcibly moved in response to engagement with the head section 24 of a rail therewith. In the illustrated embodiment, the leg 378 on at least one of the inner and outer arms 372, 373 of each derailment apparatus is pivotally arranged in operable combination with the respective arm. It will be appreciated, however, other forms for permitting movement of leg 378, including, but not limited to, single-unit construction of leg 378 and pivot pin 385 are within the spirit and scope of this invention disclosure. Moreover, and with relatively slight redesign, leg 378 can be designed to slidably move rather than pivot relative to the respective arm of the derailment apparatus without detractor departing from the spirit and novel concept of this aspect of the invention disclosure.

In the embodiment illustrated by way of example in FIGS. 22 through 25, the outer arm 373 of each derailment apparatus defines an opening 384 which receives and accommodates for pivotal movement of one end of the leg 378. Preferably, an elongated pivot pin 385 passes longitudinally through the outer arm 373 and through the opening 374. In one form, the pin 385 is secured against endwise movement and defines a pivot axis 386 for leg 378.

In one form, the movable leg 378 of each derailment apparatus is biased into a position where the leg 378 laterally projects toward the outer side of the adjacent wheel 38, 38' (FIGS. 20 and 21) but is movable toward another position (FIG. 25) where the leg 378 permits the head section 24 of the rail to move therepast. Preferably, the leg 378 is biased into the position shown in FIGS. 23 and 24, by a spring 387. More specifically, in one form, a torsion spring having one end 387 engagable with leg 378 and a second end 388 engagable with the outer arm of the respective derailment apparatus is used to resiliently bias leg 378 into the position illustrated in FIGS. 23 and 24. Cooperating and coacting surfaces 379 and 389 on leg 378 and the outer arm 373, respectively, of the respective derailment apparatus limit and control the pivotal positioning of the leg 378 in one direction about axis 386. Similarly, cooperating and coacting surfaces 380 and 389 on leg 378 and the outer arm 373, respectively, of the respective derailment apparatus limit and control the pivotal positioning of the leg 378 in a second direction, opposed to said first direction, and about axis 386.

Figure 23:
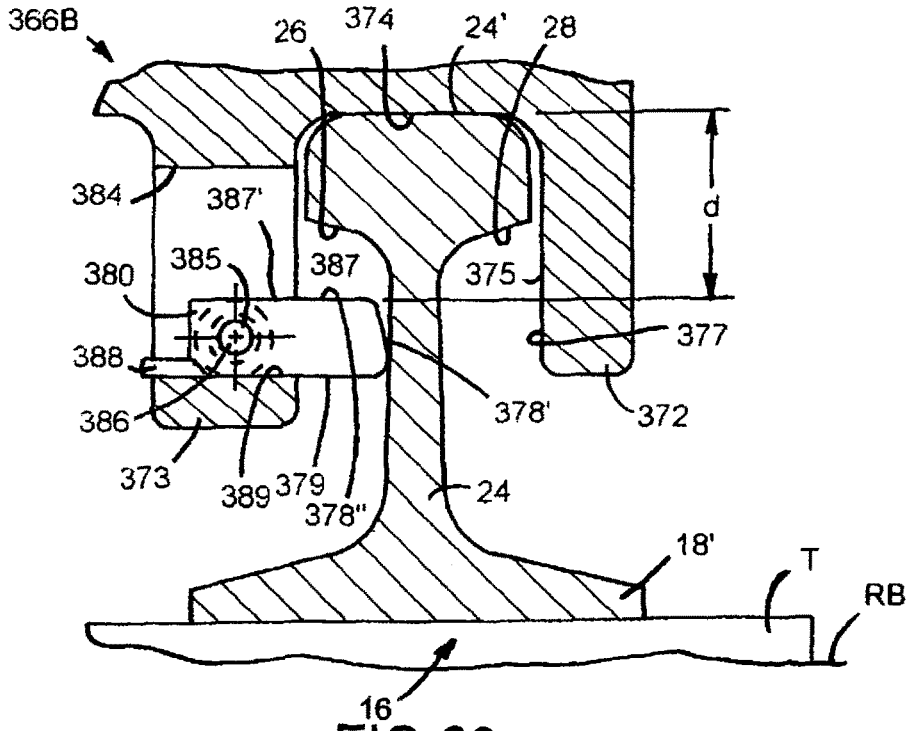
FIG. 23 is an enlarged fragmentary sectional view of the area encircled in phantom lines in FIG. 21.
Figure 24:
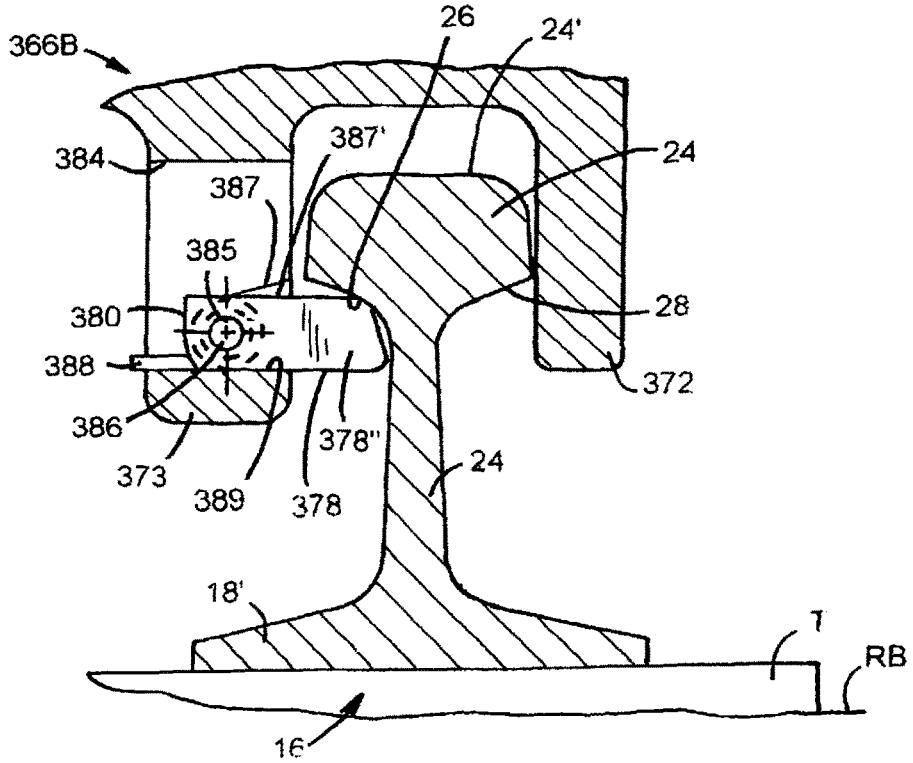
FIG. 24 is a view similar to FIG. 23 showing the relative positions of the various components when a railway vehicle tends to tip in a clockwise direction upon a derailment.

Returning to FIG. 23, the leg 378 of each derailment apparatus terminates in a free end 378' which is laterally spaced from an inner surface 377 of the opposed arm. As schematically illustrated in FIG. 23, the free end 378' of leg 378 is laterally spaced from the inner surface 377 of the opposed free-ended arm 372 of the respective apparatus 166 by a distance less than or equal to the predetermined width PW (FIG. 2) of the head section 24 of the either rail 18, 18' (FIG. 3). Notably, an upper surface of leg 378" is vertically spaced from the upper surface 374 of the pocket 375 of the respective derailment apparatus by a distance "d" greater than or equal to the distance separating either downwardly facing shoulder 26, 28 from the wheel engaging surface 24' on the head section 24 of either rail.

Figure 25:
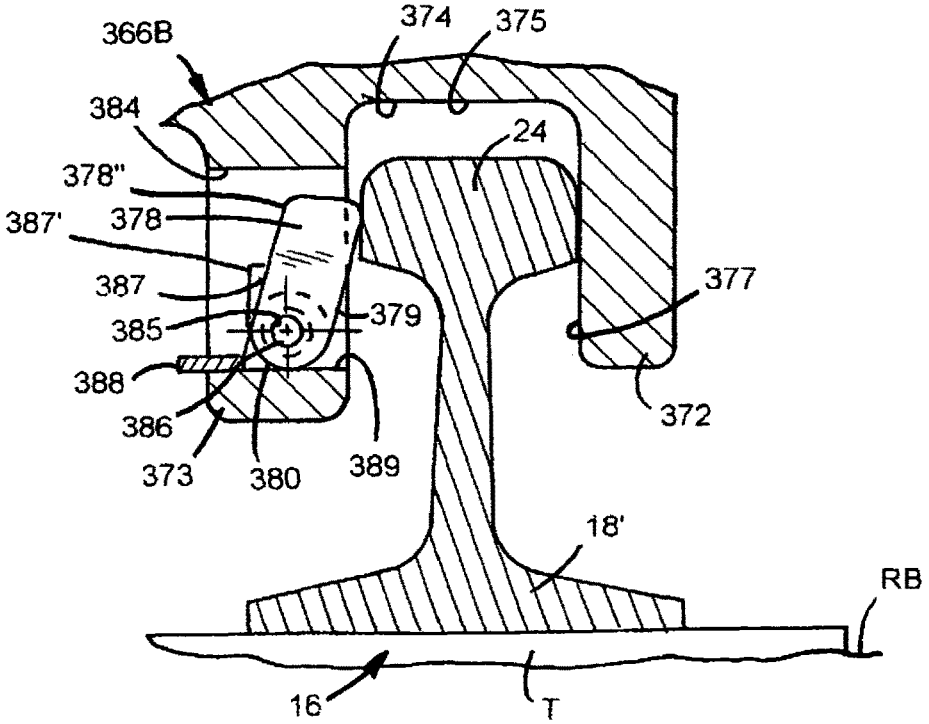
FIG. 25 is a view similar to FIG. 23 showing displacement of a horizontal component forming part of an alternative embodiment of the present invention disclosure.

As mentioned above, and upon a derailment, the arms 372, 373 of each apparatus 366A and 366B of each derailment set operably associated with the side frame 30' drop toward the rail 18' to receive and accommodate a lengthwise portion of the rail 18' within the pocket 375 defined by each derailment apparatus on side frame 30'. As schematically shown in FIG. 25, as each derailment apparatus drops toward the rails, the leg 378 of each derailment apparatus resiliently deflects to allow the head section 24 of the rail 18' to be received and accommodated within the respective pocket 375. As will be appreciated, after the head section of the rail 18' passes the leg 378 of each derailment apparatus, the leg 378 will resiliently return to the position shown in FIG. 23 whereat the upper surface 378" of the leg 378 is disposed below the adjacent downwardly facing shoulder 26, 28 on the adjacent rail. Accordingly, either or both inner surfaces on arms 372 and 373 can engage with the sides of the head section 24 of the captured rail 18' while the free end 378' of the leg 378 can operably engage a side surface on the middle section 22 of the rail, thus, inhibiting excessive lateral movement and/or displacement of the respective railway vehicle truck 14, 14' (FIG. 1) while facilitating braking of vehicle upon derailment.

In the example illustrated by way of example in FIGS. 21 and 23, and upon derailment of wheel 38' from rail 18', and after rail 18' is accommodated in the pocket 375, the top wall or surface 374 of the cavity or pocket 375 engages with surface 24' of rail 18'. It will be appreciated, however, the pocket 375 of both the first derailment apparatus 366A and the second derailment apparatus 366B in each derailment set can be designed such that the upper surface 374 partially defining pocket 375 therein can be vertically spaced from the wheel engaging surface 24' when rail 18' is captured therein without detracting or departing from the spirit and novel scope of this invention disclosure. In the embodiment illustrated by way of example in FIG. 21, and upon derailment, the wheel 38' will be permitted to run along the roadbed RB, with the respective rail 18' being captured in the pocket 375 and between the arms 372, 373 of the respective derailment apparatus 366A, 366B. In the illustrated embodiment, a bracket or gusset 376' is preferably arranged in operable combination with the each apparatus 366A and 366B to strengthen and add rigidity as well as support to each derailment apparatus As mentioned above, and for many reasons, a railway vehicle can tend to overturn upon itself as it leaves contact with the rails. In this alternative embodiment, however, as the derailed wheel 38' raises from the rail, the upper surface 378" of leg 378 engages the respective downwardly facing shoulder 26, 28 on the rail whereby inhibiting the railway vehicle from overturning and thereby advantageously enhancing containment of the derailment to minimize damage and economic loss. At the same time, the free end of leg 378 engages the respective downwardly facing shoulder 26, 28 on the rail 18' to continue to add to the braking function of each apparatus 366A and 366B.

In the embodiment illustrated in FIGS. 20, 21 and 23 through 25, the outer arm 373 of each derailment apparatus set including derailment apparatus 366A and 366B depends from the top wall or surface 374 on each apparatus or the respective side frame a greater distance than does the inner arm 372.

In a preferred embodiment, at least one derailment apparatus 366A and 366B of each derailment set further includes equipment, generally indicated in phantom lines and identified in FIGS. 20 and 21 by reference numeral 380, for detecting and/or sensing derailment of the railway vehicle 10 (FIG. 1) from either rail 18, 18'. As mentioned above, the equipment 380 can be of any of a variety of different types without detracting or departing from the spirit and scope of the present invention disclosure. In one form, equipment 380 can be of the type described above regarding equipment 80. Suffice it to say, equipment 380 provides a signal indicative of the derailment of the railway vehicle 10 from either rail 18, 18'.

From the foregoing, it will be observed that numerous modifications and variations can be made and effected without departing or detracting from the true spirit and novel concept of this invention disclosure. Moreover, it will be appreciated, the present disclosure is intended to set forth exemplifications which are not intended to limit the disclosure to the specific embodiments illustrated. Rather, this disclosure is intended to cover by the appended claims all such modifications and variations as fall within the spirit and scope of the claims.

What is claimed is:

1. A system for containing derailment of a railway vehicle from a rail system including a pair of laterally spaced rails over which said railway vehicle travels, with each rail having a base section, an upstanding middle section joined to said base section and a head section joined to said middle section and having a predetermined width, and with said railway vehicle having a pair of laterally spaced side frames which mount wheels carried by axles for rotation about a fixed axis, with said derailment system comprising:

a derailment apparatus provided on each side frame, with each derailment apparatus having inner and outer laterally spaced and free ended arms arranged outboard of a respective wheel and depending from the respective side frame and disposed above the head section of the rails as long as said wheels ride on the head section of the rails, with the lateral spacing between said arms being equal to or greater than the predetermined width of the head section on either rail to define a pocket therebetween such that in the event either wheel becomes derailed one of the rails is received and accommodated within the pocket defined by the respective derailment apparatus, with the free-end of each depending arm of the derailment apparatus being adapted to extend below and to opposed sides of the head section of the rail accommodated in said pocket of the respective derailment apparatus whereby inhibiting total derailment of the railway vehicle from the rails over which the railway vehicle is traveling.

2. The system for containing derailment of a railway vehicle according to claim 1, wherein the outer arm of each derailment apparatus depends from the respective side frame a greater distance than does the inner arm of each derailment apparatus.

3. The system for containing derailment of a railway vehicle according to claim 1, wherein a bottom edge of the inner and outer depending arms is positioned above a wheel engaging surface on the head section of the rail by a distance less than a height of the rail as long as the railway vehicle is positioned on the rails.

4. The system for containing derailment of a railway vehicle according to claim 1, wherein each arm of each derailment apparatus defines an inner side surface for operably engaging a side of the head section of the adjacent rail when the railway vehicle wheel is derailed.

5. The system for containing derailment of a railway vehicle according to claim 4, wherein the inner surfaces defined by the inner and outer arms of each derailment apparatus angularly diverge relative to each other along at least a portion of their lengths.

6. The system for containing derailment of a railway vehicle according to claim 1, further including equipment for detecting derailment of the railway vehicle from either rail.

7. The system for containing derailment of a railway vehicle according to claim 6, wherein said detecting equipment is electrically operated.

8. The system for containing derailment of a railway vehicle according to claim 6, wherein said detecting equipment includes an apparatus for transmitting information to a location remote from said side frame whereat said derailment occurs.

9. A system for containing derailment of a railway vehicle from a rail system including a pair of laterally spaced rails over which said railway vehicle travels, with each rail having a base section, an upstanding middle section joined to said base section and a head section joined to said middle section and having a predetermined width, and with said railway vehicle having a pair of laterally spaced side frames disposed toward opposed ends of said railway vehicle, with wheels carried by axles mounted by said side frame for rotation about a fixed axis, with said derailment system comprising:

a derailment apparatus provided on each side frame, with each derailment apparatus having inner and outer laterally spaced and rigid free-ended arms disposed above the head section of the rails as along as the wheels ride along said rails and extending lengthwise of the respective side frame, with the lateral spacing between said arms being equal to or greater than the predetermined width of the head section on either rail, and with at least one of the inner arm and outer arm of each derailment apparatus having a generally horizontal free-ended component which is adapted to be operably disposed beneath the head section of the adjacent rail in the event a wheel drops off a rail whereby inhibiting total derailment of the railway vehicle from the rails over which the railway vehicle is traveling.

10. The system for containing derailment of a railway vehicle according to claim 9, wherein each arm of each derailment apparatus defines an inner side surface for operably engaging a side of the head section of the adjacent rail when the railway vehicle wheel is derailed, and wherein the inner surfaces defined by the inner and outer arms of each derailment apparatus angularly diverge relative to each other along at least a portion of their lengths.

11. The system for containing derailment of a railway vehicle according to claim 9, wherein the outer arm of each derailment apparatus depends a greater distance from the lower surface of a respective side frame than does the inner arm of each derailment apparatus.

12. The system for containing derailment of a railway vehicle according to claim 9, wherein the outer arm of each derailment apparatus extends lengthwise of a respective side frame a greater distance than does the inner arm.

13. The system for containing derailment of a railway vehicle according to claim 9, wherein the outer arm of each derailment apparatus has a generally L-shaped configuration, with a lower free-end of said outer arm extending laterally inward toward the adjacent wheel on said railway vehicle.

14. The system for containing derailment of a railway vehicle according to claim 9, wherein the outer arm of each derailment apparatus has a generally vertical section attached to and depending from one of said side frames and with the generally horizontal free-ended component extending laterally from said vertical section and toward an adjacent wheel on said railway vehicle.

15. The system for containing derailment of a railway vehicle according to claim 9, wherein the generally horizontal free-ended component on at least one of the inner and outer arms of each derailment apparatus is configured to promote engagement with a downwardly disposed shoulder on said rail.

16. The system for containing derailment of a railway vehicle according to claim 9, wherein each of the inner and outer arms of each derailment apparatus has a generally vertical section attached to and depending from one of said side frames, and wherein at least one of the inner and outer arms has the generally horizontal free-ended component extending laterally from said vertical section.

17. The system for containing derailment of a railway vehicle according to claim 9, wherein the generally horizontal free-ended component on at least one of the inner and outer arms of each derailment apparatus is movably connected to a remainder of said arm.

18. The system for containing derailment of a railway vehicle according to claim 17, wherein the generally horizontal free-ended component on one of the inner and outer arms of each derailment apparatus is biased into position relative to the remainder of said arm.

19. A system for containing derailment of a railway vehicle from a rail system including a pair of laterally spaced rails over which said railway vehicle travels, with each rail having a base section, an upstanding middle section joined to said base section and a head section joined to said middle section and having a predetermined width, with said rail further defining two downwardly disposed shoulders on opposite lateral sides of the middle section, and with said railway vehicle having a pair of laterally spaced side frames with wheels carried by axles for rotation about a fixed axis, with said derailment system comprising:

a derailment apparatus provided on each side frame, with each derailment apparatus having an arm depending from each side frame, with a free end of said arm being disposed above the head section of each rail and laterally outward from the respective wheel as long as said wheels ride along said rails, and with said free-ended arm on said derailment apparatus having a generally horizontal component which, upon a derailment, is adapted to be operably disposed below the head section of one of the rails in a position to operably engage with one of the downwardly disposed shoulder on one of said rails whereby inhibiting total derailment of the railway vehicle from the rails over which the railway vehicle is traveling.

20. The system for containing derailment of a railway vehicle according to claim 19, wherein the arm of each derailment apparatus has an open-sided generally hook-like configuration, with said hook-like configuration opening toward an adjacent wheel on said railway vehicle.

* * * * *